US005828167A

United States Patent [19]

Jitsukata et al.

[11] Patent Number: 5,828,167

[45] Date of Patent: Oct. 27, 1998

[54] COLOR CATHODE RAY TUBE WITH A DYNAMIC CONVERGENCE DEVICE AND COLOR DISPLAY SYSTEM EMPLOYING SAME

[75] Inventors: Hiroshi Jitsukata; Soichi Sakurai, both of Yokohama; Hiroshi Yoshioka, Mobara; Yoshio Sato, Chousei-gun; Hiroshi Sasaki; Hidetsuyo Baba, both of Mobara, all of Japan

[73] Assignee: Hitachi, Ltd., Tokyo, Japan

[21] Appl. No.: 684,341

[22] Filed: Jul. 19, 1996

[30] Foreign Application Priority Data

Jul. 24, 1995 [JP] Japan ..... 7-186756
Sep. 18, 1995 [JP] Japan ..... 7-238729

[51] Int. Cl.[6] ..... H01J 29/70

[52] U.S. Cl. ..... 313/412; 313/414; 313/428; 313/430; 313/450

[58] Field of Search ..... 313/412, 414, 313/428, 430, 450

[56] References Cited

U.S. PATENT DOCUMENTS

| | | | |
|---|---|---|---|
| 4,455,541 | 6/1984 | Nosaka | 313/428 |
| 4,896,071 | 1/1990 | Pons | 313/428 |
| 4,900,979 | 2/1990 | Shimoma et al. | 313/428 |
| 5,015,925 | 5/1991 | Spanjer et al. | 313/414 |
| 5,227,692 | 7/1993 | Lee | 313/428 |
| 5,233,267 | 8/1993 | Tominaga et al. | 313/428 |
| 5,512,802 | 4/1996 | Jamar . | |

FOREIGN PATENT DOCUMENTS 6-223746 8/1994 Japan .

*Primary Examiner*—Nimeshkumar Patel
*Attorney, Agent, or Firm*—Antonelli, Terry, Stout & Kraus, LLP

[57] ABSTRACT

A color cathode ray tube includes a three beam inline electron gun; a deflection device for performing deflection and self-convergence; a static beam convergence device having permanent magnets for generating a magnetic field adjustable to converge three electron beams at a central portion of a phosphor screen; and a dynamic convergence device having coreless electromagnetic coils for generating a magnetic field adjustable to converge three electron beams at peripheral portions of the phosphor screen. The dynamic beam convergence device includes a spiral coil conductor formed on a non-magnetic film. The dynamic beam convergence device also includes two cylindrical holder members having large and small diameters, respectively, made of an insulating material, which are held in such a manner as to be coaxial and overlapped on each other; and a coil member including a plurality of printed coils for generating magnetic fields having an even number of poles contained in a flexible film, the coil member being disposed between the two cylindrical holder members having large and small diameters respectively; wherein a plurality of the printed coils are stacked in the flexible film in such a manner as to be insulated from each other; and printed coils adjacent to each other and having the same diameter are electrically connected to each other in the flexible film.

57 Claims, 17 Drawing Sheets

FIG. 8

| | CONVERGENCE COILS | MISCONVERGENCE PATTERNS | CORRECTION CURRENT WAVEFORMS |
|---|---|---|---|
| a | 23 | B R B R | 1H |
| b | 24 | G R,B R,B G | 1V |
| c | 22 | R R B B | 1V |
| d | 25 | R,B G | 1V |

COLOR CATHODE RAY TUBE WITH A DYNAMIC CONVERGENCE DEVICE AND COLOR DISPLAY SYSTEM EMPLOYING SAME

BACKGROUND OF THE INVENTION

The present invention relates to a display system using a cathode ray tube, and particularly to a cathode ray tube display system including a convergence device having an electromagnetic coil which is provided on a neck portion of a cathode ray tube.

A known cathode ray tube provided with an in-line electron gun in combination with a deflection yoke which generates a pincushion-shaped horizontal deflection magnetic field and a barrel-shaped vertical deflection magnetic field can converge three electron beams over the entire phosphor screen, and has been used in various color display systems.

In the case of an image display by a color cathode ray tube, a convergence correction device is generally mounted on a neck portion for effecting static convergence of three electron beams (for three colors) emitted from an electron gun.

To achieve superior convergence a dynamic convergence device is used to generate correction magnetic fields by a plurality of electromagnetic coils provided at an end of a deflection yoke for converging three electron beams for red, green and blue.

When a cathode ray tube display system standardized for mass production is designed to provide substantial convergence of the three beams at all points at the raster without the need for a dynamic convergence device, and a high performance cathode ray tube display system is constructed by providing the standardized cathode ray tube display system with the dynamic convergence device, this common use of the basic cathode ray tube portion in the display systems makes possible the economical production of the display systems. But this poses a problem in that characteristics of the deflection yoke are adversely affected in the high performance cathode ray tube display system. A magnetic field generated by the deflection yoke is distorted by the dynamic convergence device and degrades the performance of the deflection yoke. In particular, since the magnetic field of an electromagnetic coil of the dynamic convergence device must be strengthened when a distance between the dynamic convergence device and electron beams is large, the magnetic field generated by the deflection yoke is largely affected by the strengthened magnetic field of the electromagnetic coil, and increase in the deflection current enlarges a drive circuit.

Various kinds of convergence correction devices have been developed, and in recent years, a flexible support type convergence correction device has been disclosed, for example in Japanese Patent Laid-open No. Hei 6-223746. In such a convergence correction device, a plurality of printed spiral coils are formed on both surfaces of one flexible support and are electrically connected to each other through openings provided in the flexible support; and such a flexible support is wound around a neck portion of a color cathode ray tube one or two turns.

In the convergence correction device having the above configuration, a plurality of the printed spiral coils, each being of a coreless type, can be disposed in such a manner as to be brought in close contact with a neck portion of a color cathode ray tube. This provides greater degree of freedom of design and a high sensitivity to a correcting coil.

In the above convergence correction device disclosed in Japanese Patent Laid-open No. Hei 6-223746, however, wherein a flexible support having a plurality of printed spiral coils formed on both surfaces thereof is wound around a neck portion of a color cathode ray tube one or two turns, there is a fear that exposed printed spiral coils are damaged by accidental contact with other conductive or insulating members in winding the flexible support around the neck portion. In particular, when the flexible support is wound two times around the neck portion of the color cathode ray tube, its exposed printed coils tend to be brought in contact with each other. To cope with such a problem, in the above convergence correction device, an electrically insulating layer is generally provided on one surface and/or the opposed surface of the flexible support for preventing the contact of the printed spiral coils with other members.

In the convergence correction device disclosed in Japanese Patent Laid-open Hei 6-223746, since an electrically insulating film is wound so as to be overlapped on the flexible support when the flexible support is wound around a neck portion of a color cathode ray tube, there is disadvantage that the thickness of the convergence correction device is increased by the thickness of the electrically insulating film; and that since an additional process of winding the electrically insulating film is required to winding of the flexible support around a neck portion of a cathode ray tube, it takes an extra labor in mounting the convergence correction device.

SUMMARY OF THE INVENTION

An object of the present invention is to provide an economical high performance cathode ray tube display system in which the performance of a deflection yoke is not adversely affected by provision of a dynamic convergence device.

Another object of the present invention is to provide a color cathode ray tube including a dynamic convergence correction device reduced in the thickness of a portion wound around a neck portion of the color cathode ray tube and simplified in mounting.

To achieve the above object, according to one embodiment of the present invention, there is provided a convergence device in which coreless electromagnetic coils formed by cylindrically stacking spiral coil conductors supported on a non-magnetic insulator are mounted around the outer periphery of a neck portion of a cathode ray tube separately from a deflection yoke, whereby four-pole magnetic fields, six-pole magnetic fields and two-pole magnetic fields generated by the coreless electromagnetic coils are applied to electron beams of red, green and blue for performing convergence adjustment and purity adjustment.

The coreless electromagnetic coils around the neck portion can be nearer to the electron beams because of absence of a core, and control the electron beams with weaker magnetic fields which affect the magnetic fields by the deflection yoke less adversely. Therefore a high performance cathode ray tube display system is realized economically by providing the standardized cathode ray tube display system originally designed not to require a dynamic convergence device serving as a basic component, with the dynamic convergence device.

According to another embodiment of the present invention, there is provided a color cathode ray tube including a convergence correction device provided on a neck portion of the color cathode ray tube, the convergence correction device including a two-coaxially-cylindrical-layer holder member made of an insulator; and a coil member having plural sets of printed coils for generating magnetic fields of an even number of poles are contained within a flexible film and inserted between the outer and inner layers of the two layer holder member, wherein the plural sets of the printed coils are stacked within the flexible film in such a manner as to be insulated from each other and the adjacent printed coils in each set are electrically connected to each other within the flexible film.

With the above configuration, the coil member inserted between the outer and inner layers of the two-coaxially-cylindrical-layer holder member is so constructed that plural sets of printed coils for generating magnetic fields having an even number of poles are stacked within a flexible film in such a manner as to be insulated from each other. This is advantageous in minimizing the thickness of the flexible film itself. The flexible film of this embodiment can be wound around a neck portion of a color cathode ray tube with the thickness sufficiently reduced as compared with the known flexible support for the convergence correction device which has been wound together with a separate electric insulating film.

Moreover, in this configuration, all printed coils are contained within the flexible film and thereby it is prevented from contact with other components. This is advantageous in eliminating the necessity of winding the flexible film together with an electrically insulating film unlike the known flexible coil, which eliminates an extra labor for mounting the convergence correction device. A further advantage of the convergence correction device is that the flexible film as the coil member can be easily and accurately positioned in the two-layer holder member only by insertion between the outer and inner layers of the two-layer holder member.

BRIEF DESCRIPTION OF THE DRAWINGS

In the drawings, which form an integral part of the specification and are to be read in conjunction therewith, and in which like reference numerals designate similar components throughout the figures, and in which:

FIG. 4A-1 is a sectional view of the coreless electromagnetic coil of FIG. 4A;

FIGS. 6A to 6C are views of a convergence device in a second embodiment of the present invention, wherein FIG. 6A is a developed view of a coreless electromagnetic coil for generating four-pole magnetic fields; FIG. 6B is a perspective view of a holder mounting the coreless electromagnetic coil; and FIG. 6C is a perspective view of a deflection yoke to which the convergence device is mounted;

FIG. 8 is a chart showing relationships between convergence error patterns and convergence correction currents for correcting the convergence errors.

FIGS. 10A to 10C are views of a convergence correction device according to a third embodiment of the present invention, wherein FIG. 10A is an exploded perspective view of the convergence correction device; Fig. 10B is a sectional view taken along the line XB—XB in FIG. 10A; and FIG. 10C is a sectional view taken along the line XC—XC in FIG. 10A;

DETAILED DESCRIPTION OF THE PREFERRED EMBODIMENTS

Hereinafter, preferred embodiments of the present invention will be described with reference to the drawings.

Figure 1:
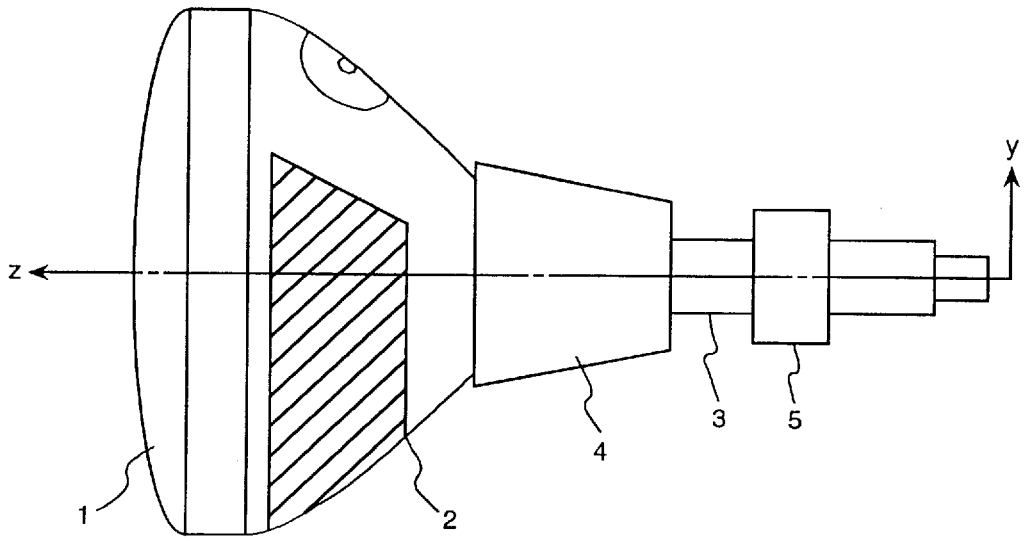
FIG. 1 is a side view of a cathode ray tube display system according to a first embodiment of the present invention.
Figure 2:
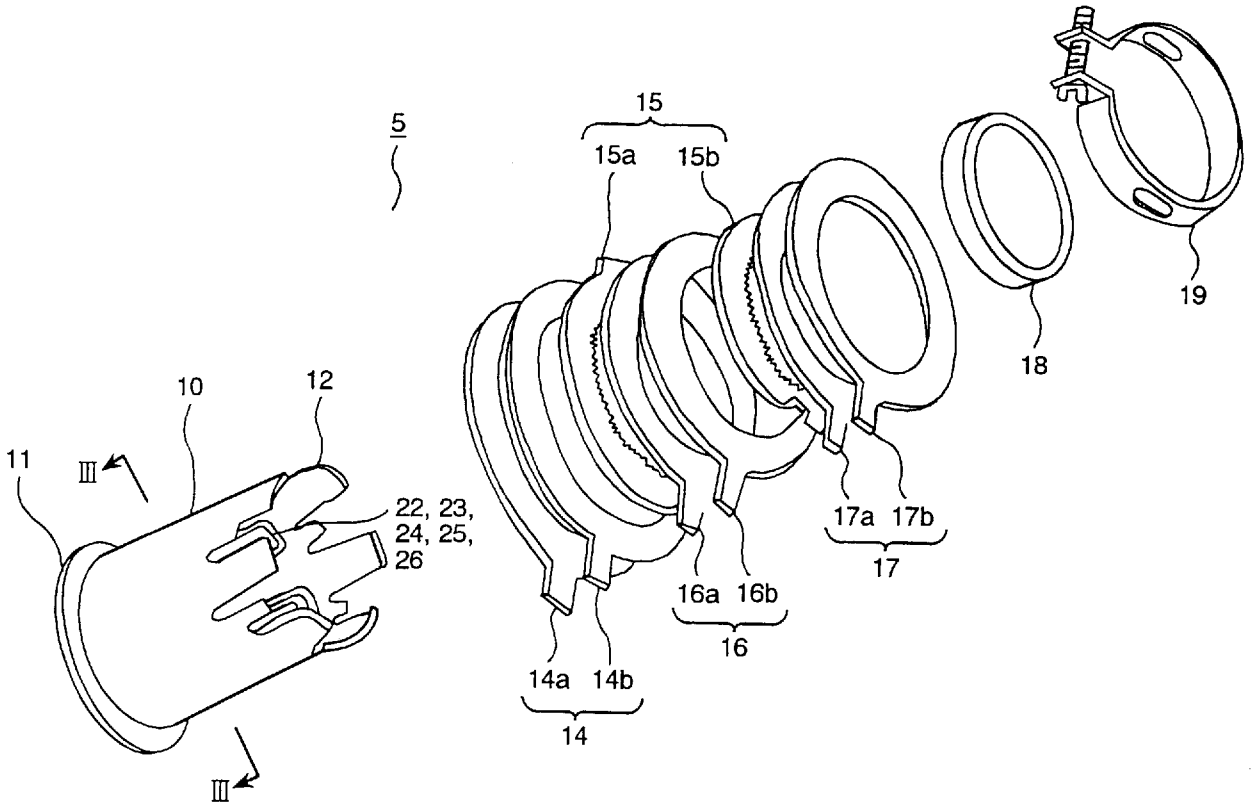
FIG. 2 is an exploded perspective view of a convergence device in the first embodiment shown in FIG. 1.
Figure 3:
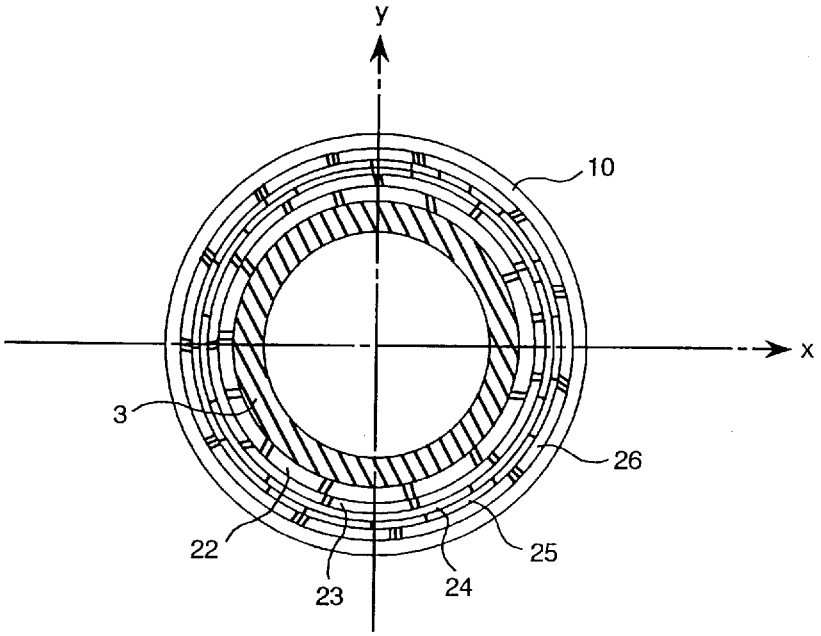
FIG. 3 is a sectional view taken along the line III—III of FIG. 2.
Figure 4A:
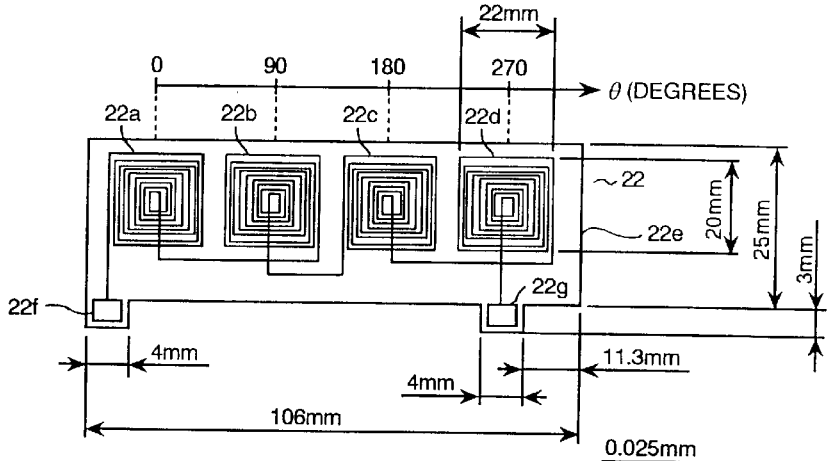
FIGS. 4A, 4B are developed views of coreless electromagnetic coils for generating four-pole magnetic fields in the first embodiment.
Figures 1, 4A:
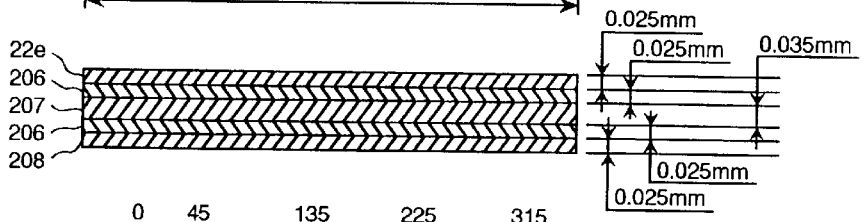

FIG. 1 is a side view of a first embodiment of a cathode ray tube display system of the present invention; FIG. 2 is an exploded perspective view of a convergence device constituting an essential portion of this embodiment; FIG. 3 is a sectional view taken along the line III—III of FIG. 2; FIG. 4A to 4E are developed views of coreless electromagnetic coils; FIG. 4A-1 is a sectional view of the coreless electromagnetic coil of FIG. 4A; FIGS. 5A to 5F are diagrams each showing a relationship between magnetic fields generated form the coreless electromagnetic coil and their forces applied to electron beams.

As shown in FIG. 1, an evacuated glass envelope in the cathode ray tube display system generally includes three portions: a panel portion 1 carrying a phosphor screen for displaying an image on its inner surface; a funnel portion 2; and a neck portion 3 accommodating an in-line electron gun (not shown). The panel portion 1 includes a phosphor screen (not shown) coated with three primary color phosphors (red, green, blue) on the inner surface of a transparent glass envelope and a color selection electrode (for example a shadow mask, not shown) disposed spaced from the phosphor screen, wherein the three primary color phosphors luminesce by bombardment of three electron beams emitted from the in-line electron gun. A self-converging deflection yoke 4 including a vertical deflection coil and a horizontal deflection coil is mounted around the neck portion 3 and the funnel portion 2 in the vicinity of their junction for deflecting an electron beam (not shown) emitted from the electron gun in the vertical and horizontal directions. Moreover, a convergence device 5 is disposed in the neck portion 3 separately from the deflection yoke 4, and a magnetic shield (not shown) is provided inside the funnel portion 2.

As shown in FIGS. 2, 3, the convergence device 5 includes coreless electromagnetic coils 22, 23 for generating four-pole magnetic fields, coreless electromagnetic coils 24, 25 for generating six-pole magnetic fields, and a coreless electromagnetic coil 26 for generating two sets of two-pole magnetic fields such that they are stacked on the inner surface of a non-magnetic cylindrical resin holder 10 with the innermost coil directly and substantially closely around the outer surface of the neck portion 3 or with a resin support (not shown) interposed between the innermost coil and the outer surface of the neck portion 3 for the purpose of disposing the convergence device 5 as close to the electron beam path as possible. Each coreless electromagnetic coil is formed of a plurality of coil conductors which are spirally wound magnet wires or are spirals formed by printing, and which are arranged on a support member of a resin film.

A two-pole magnet 14, a spacer 15*a*, a four-pole magnet 16, a spacer 15*b*, and a six-pole magnet 17 are disposed around the outer surface of the cylindrical holder 10, and are fixed thereon by means of securing rings 11, 18. The four-pole magnet 16 and the six-pole magnet 17 are used for adjustment of a so-called static convergence (convergence of three electron beams), the four-pole magnet 16 comprises a pair of juxtaposed magnet rings 16*a*, 16*b* and the six-pole magnet 17 comprises a pair of juxtaposed magnetic rings 17*a*, 17*b*. Strengths of generated magnetic fields adjusted by relative rotational positions of the paired magnetic rings and the directions of the generated magnetic fields are adjusted by the collective rotational positions of the paired magnet rings. The two-pole magnet 14 is used for adjustment of a color purity, and comprises a pair of juxtaposed magnet rings 14*a* and 14*b*. The strength of generated magnetic field is adjusted by a relative rotational positions of the paired magnetic rings and the direction of the generated magnetic field is adjusted by the collective rotational positions of the paired magnet rings. Fingers 12 integrally formed at an end portion of the holder 10 are clamped around the outer surface of the neck portion 3 by a clamping band 19.

FIGS. 4A to 4E are developed views of the coreless electromagnetic coils 22, 23, 24, 25 and 26, respectively.

Figure 4B:
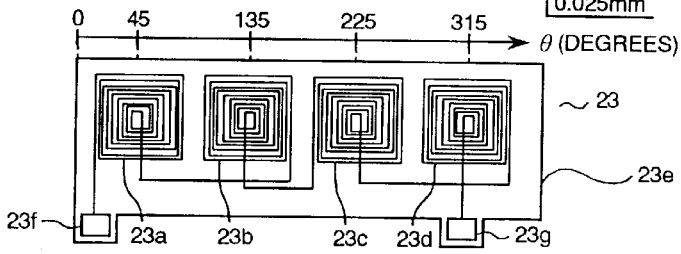

FIGS. 4A, 4B show the coreless electromagnetic coils 22, 23 for generating four-pole magnetic fields, respectively. In FIG. 4A, the coreless electromagnetic coil 22 is configured such that square spiral coil conductors 22*a* to 22*d* are disposed on a non-magnetic resin supporting film 22*e* with the respective centers of the coil conductors 22*a* to 22*d* located at four positions equally spaced around the outer surface of the neck portion 3, θ=0, 90, 180 and 270° with respect to the y-axis, and connection terminals 22*f*, 22*g* are respectively connected to the coil conductors 22*a*, 22*d*. FIG. 4A-1 is a sectional view of the coreless electromagnetic coil 22 shown in FIG. 4A. In the coreless electromagnetic coil 22, the coil conductors 22*a*, 22*c* generate magnetic fields of one polarity while the coil conductors 22*b*, 22*d* generate magnetic fields of the other polarity, to thus generate the four-pole magnetic fields shown in FIG. 5A.

One dimensional example of the coil 22 is as follows: the outer dimension is 106×25×0.135 ($mm^3$); and each coil conductor is formed of a copper foil 207 of a thickness of 35 μm which is a spiral of ten turns and of a size of 20×22 ($mm^2$). The supporting film 22*e* is formed of a polyimide film having a thickness of 25 μm. In FIG. 4A-1, reference numeral 206 indicates an adhesive, and reference numeral 208 indicates a resin film.

Referring to FIG. 4B, the coreless electromagnetic coil 23 is configured such that square spiral coil conductors 23*a* to 23*d* are disposed on a non-magnetic resin supporting film 23*e* with the respective centers of the coil conductors 23*a* to 23*d* located at positions of θ=45, 135, 225 and 315°, and connection terminals 23*f*, 23*g* are respectively connected to the coil conductors 23*a*, 23*d*. In the coreless electromagnetic coil 23, the coil conductors 23*a*, 23*c* generate magnetic fields of one polarity while the coil conductors 23*b*, 23*d* generate magnetic fields of the other polarity, to thus generate the four-pole magnetic fields shown in FIG. 5B.

Figure 5A:
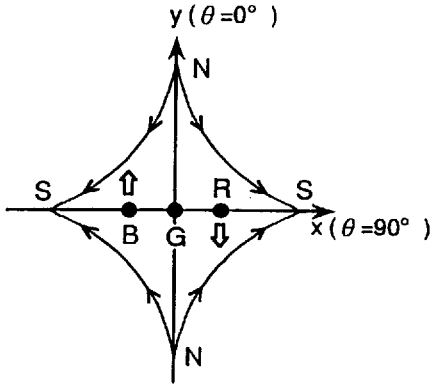
FIG. 5A, 5B show a relationship between four-pole magnetic fields and their forces applied to electron beams in the first embodiment.
Figure 5B:
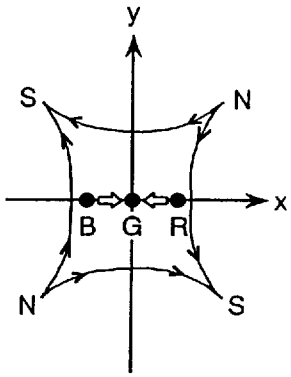

White arrows in FIGS. 5A, 5B indicate forces exerted by the above-described four-pole magnetic fields on electron beams of red (R), green (G) and blue (B) arranged horizontally in a line centering on the tube axis Z. The four-pole magnetic fields generated by the coreless electromagnetic coil 22 move side electron beams R, B in the opposite vertical directions (y-axis), while the four-pole magnetic fields generated by the coreless electromagnetic coil 23 move the side electron beams R, B in the opposite horizontal directions (x-axis).

Figure 4C:
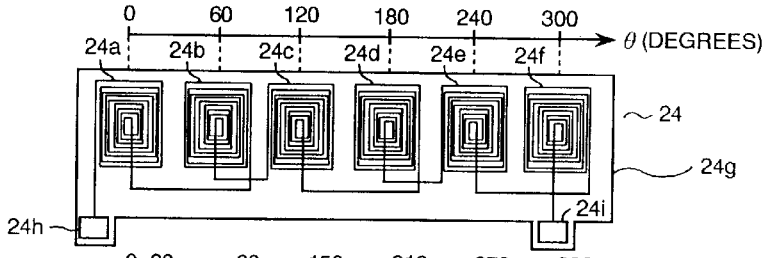
FIGS. 4C, 4D are developed views of coreless electromagnetic coils for generating six-pole magnetic fields in the first embodiment.
Figure 4D:
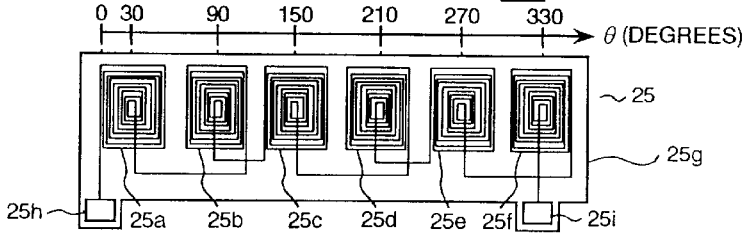

FIGS. 4C, 4D show the coreless electromagnetic coils 24, 25 for generating six-pole magnetic fields, respectively. The coreless electromagnetic coil 24 is configured such that square shaped spiral coil conductors 24*a* to 24*f* are disposed on a non-magnetic resin supporting film 24*g* with the respective centers of the coil conductors 24*a* to 24*f* located at six positions equally spaced around the outer surface of the neck portion 3, θ=0, 60, 120, 180, 240 and 300°, and connection terminals 24*h*, 24*i* are respectively connected to the coil conductors 24*a*, 24*f*. In the coreless electromagnetic coil 24, the coil conductors 24*a*, 24*c*, 24*e* generate magnetic fields of one polarity while the coil conductors 24*b*, 24*d*, 24*f* generate magnetic fields of the other polarity, to thus generate the six-pole magnetic fields shown in FIG. 5C.

Similarly, the coreless electromagnetic coil 25 is configured such that square spiral coil conductors 25*a* to 25*f* are disposed on a non-magnetic resin supporting film 25*g* with the respective centers of the coil conductors 25*a* to 25*f* located at six positions equally spaced around the outer surface of the neck portion 3, θ=30, 90, 150, 210, 270 and 330°, and connection terminals 25*h*, 25*i* are respectively connected to the coil conductors 25*a*, 25*f*. In the coreless electromagnetic coil 25, the coil conductors 25*a*, 25*c*, 25*e* generate magnetic fields of one polarity while the coil conductors 25*b*, 25*d*, 25*f* generate magnetic fields of the other polarity, to thus generate the six-pole magnetic fields shown in FIG. 5D.

Figure 5C:
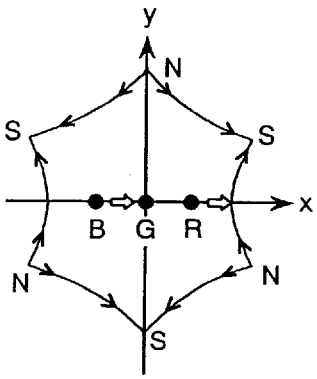
Fig. 5C, 5D show a relationship between six-pole magnetic fields and their forces applied to electron beams in the first embodiment.
Figure 5D:
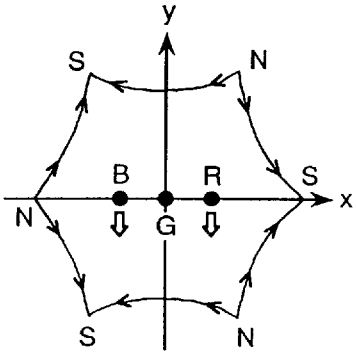

White arrows in FIGS. 5C, 5D indicate forces exerted by the above-described six-pole magnetic fields on three electron beams. The six-pole magnetic fields generated by the coreless electromagnetic coil 24 move side electron beams in the same horizontal direction (x-axis), while the six-pole magnetic fields generated by the coreless electromagnetic coil 25 move the side electron beams in the same vertical direction (y-axis).

The coreless electromagnetic coils 22, 23 for generating four-pole magnetic fields and the coreless electromagnetic coils 24, 25 for generating six-pole magnetic fields generate the above-described four-pole magnetic fields and six-pole magnetic fields respectively when correction currents modulated in synchronization with horizontal and vertical deflections of the electron beams are supplied to the connection terminals 22*f*, 22*g*, 23*f*, 23*g*, 24*h*, 24*i*, 25*h* and 25*i*, to move side electrons R, B for correcting convergence errors over the entire phosphor screen, thus reproducing a high quality image.

Figure 7:
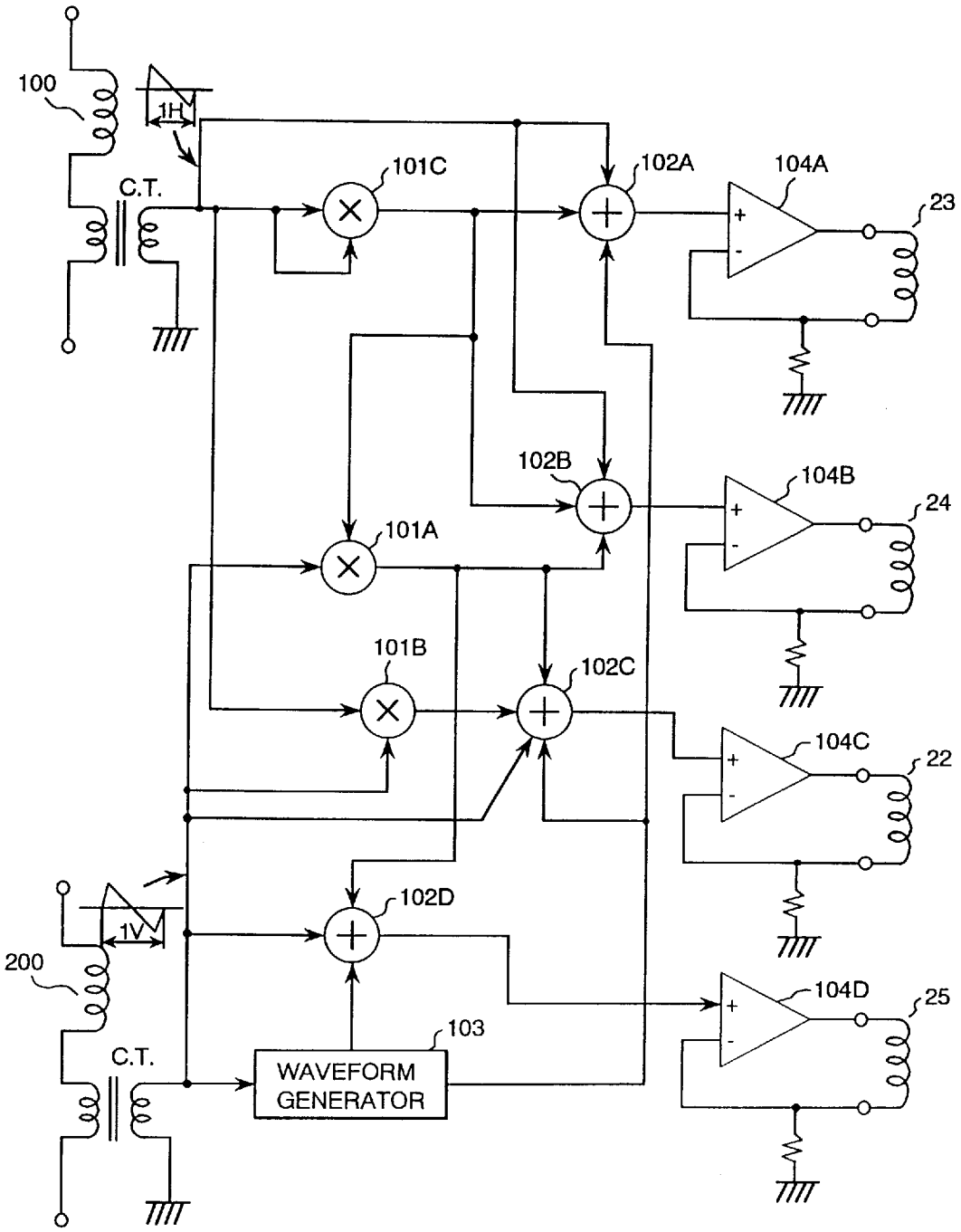
FIG. 7 is a diagram of a convergence correction circuit for supplying convergence correction currents to coreless electromagnetic coils for generating four-pole magnetic fields and coreless electromagnetic coils for generating six-pole magnetic fields.

FIG. 7 shows a convergence correcting circuit for supplying convergence currents to the coreless electromagnetic coils 22, 23 for generating four-pole magnetic fields and the coreless electromagnetic coils 24, 25 for generating six-pole magnetic fields, and FIG. 8 shows typical convergence error patterns and convergence correction current waveforms for correcting the convergence errors.

In FIG. 7, reference numerals 100, 200 indicate horizontal and vertical deflection coils, respectively; 103 is a waveform generator; C.T is a current transformer; 101A to 101C are multipliers; 102A to 102D are adders; and 104A to 104D are voltage-current converters.

In FIG. 8, reference characters R, G and B indicate raster patterns on a phosphor screen generated by electron beams of red, green and blue, respectively; and 1H, 1V are one horizontal scanning period, and one vertical scanning period, respectively.

A deflection current of a saw-tooth waveform of a period 1H which flow in the horizontal deflection coil 100, is converted into a voltage waveform by the C. T, and then the saw-tooth voltage waveform of a period 1H is inputted into the multiplier 101C, to obtain at the output terminal thereof a parabolic voltage waveform of a period 1H. On the other hand, a deflection current of a saw-tooth waveform of a period 1V, which flows in the vertical deflection coil 200, is inputted into the waveform generator 103 after converted into a voltage waveform, to obtain at the output terminal thereof a voltage waveform in which the saw-tooth voltage waveform of a period 1H is separated into positive and negative portions.

Either of a voltage of a parabolic waveform of a period 1H, a voltage of a saw-tooth waveform of a period 1H, a voltage of a parabolic waveform of a period 1V, a voltage of a saw-tooth waveform of a period 1V, and a voltage of a positive or negative portion of a saw-tooth voltage waveform of a period 1V is supplied as a correction voltage to the input terminals of the adders 102A to 102D connected to the positive terminals of the voltage-current converters 104A to 104D for supplying correction currents to the coreless electromagnetic coils 22, 23 for generating four-pole magnetic fields and coreless electromagnetic coils 24, 25 for generating six-pole magnetic fields. The amplitude of each correction voltage is adjusted in accordance with a misconvergence pattern on the phosphor screen, to adjust a waveform of a correction current to be supplied to each of the coreless electromagnetic coils 23, 24, 25 and 26. FIG. 8 shows typical misconvergence patterns and correction current waveforms for correcting the misconvergences. As shown in example "a" in FIG. 8, in order to converge vertical lines of R, B on the vertical line of G, a parabolic current of 1H is supplied to the coreless electromagnetic coil 23 for generating four-pole magnetic fields (generated magnetic fields are shown in FIG. 5B), to generate forces to move the electron beams of R, B on the opposite directions toward the electron beam of G at the right and left sides of the phosphor screen. As shown in example "b" in FIG. 8, in order to correct a misconvergence pattern in which the vertical lines of R, B are curved inwardly from the vertical line of G at the four corners of the phosphor screen, a correction current of a saw-tooth waveform of 1V superimposed with a parabolic waveform of 1H is supplied to the coreless electromagnetic coil 24 for generating six-pole magnetic fields (generated magnetic fields are shown in FIG. 5C), to generate forces to move the electron beams of R, B toward the electron beam of G at the four corners of the phosphor screen. As shown in examples "c", "d" in FIG. 8, in order to converge electron beams of R, B on an electron beam of G on the top and bottom of the phosphor screen, a correction current of a saw-tooth waveform of 1V superimposed with a parabolic waveform of 1H is supplied to each of the coreless electromagnetic coil 24 for generating four-pole magnetic fields (generated magnetic fields are shown in FIG. 5A) and the coreless electromagnetic coil 25 for generating six-pole magnetic fields (generated magnetic fields are shown in FIG. 5D). In addition, although the misconvergence patterns are not limited to those shown in FIG. 8, any misconvergence can be substantially perfectly corrected by optimally adjusting the amplitude of each correction current, to thereby obtain a high quality reproduced image.

Figure 4E:
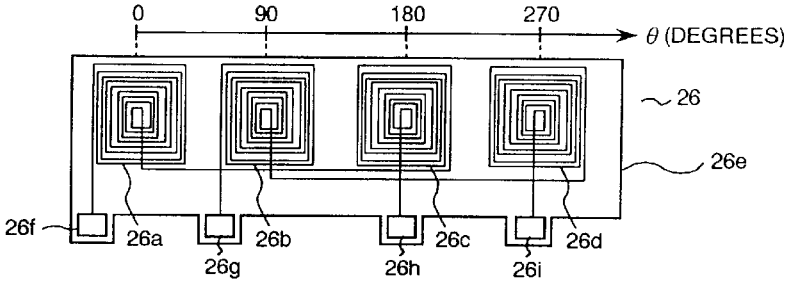
FIG. 4E is a developed view of a coreless electromagnetic coil for generating two-pole magnetic fields in the first embodiment.
Figure 5E:
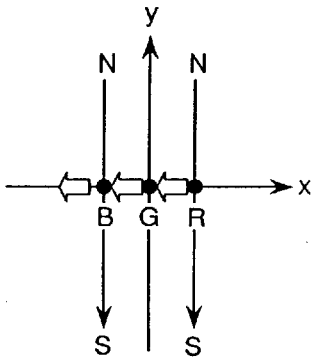
FIG. 5E, 5F show a relationship between two-pole magnetic fields and their forces applied to electron beams in the first embodiment.

FIGS. 4E shows the coreless electromagnetic coil 26 for generating two-pole magnetic fields. The coreless electromagnetic coil 26 is configured such that square spiral coil conductors 26*a*, 26*c* are disposed on a non-magnetic resin supporting film 26*e* with the respective centers of the coil conductors 26*a*, 26*c* located at two positions equally spaced around the outer surface of the neck portion 3, $\theta=0$ and 180°, for generating two-pole magnetic fields as shown in FIG. 5E, and square spiral coil conductors 26*b*, 26*d* are also disposed on the supporting film 26*e* at two positions of $\theta=90$ and 270° for generating two-pole magnetic fields shown in FIG. 5F. The two-pole magnetic fields generated by the coil conductors 26*a*, 26*c* of the coreless electromagnetic coil 26 move the three electron beams of R, G, B in the horizontal direction, while the two-pole magnetic fields generated by the coil conductors 26*b*, 26*d* of the coreless electromagnetic coil 26 move the three electron beams of R, G, B in the vertical direction. The coreless electromagnetic coil 26 is supplied with a correction current through two sets of connection terminals 26*f* to 26*i*, to generate two-pole magnetic fields. The movement of the three electron beams of R, G, B by two-pole magnetic fields is adjusted to achieve a color purity over the entire phosphor screen and hence to obtain a high quality reproduced image. Additionally, the convergence device 5 may be so designed as to adjust a correction current applied to the coreless electromagnetic coil 26 from the exterior, so that in the case where a force exerted on electron beams by the earth's magnetic field is changed due to movement of the image display system and thereby a color purity is degraded, the correcting current applied to the coreless electromagnetic coil 26 can be re-adjusted.

The convergence device 5 does not necessarily include all of the coreless electromagnetic coils 22, 23 for generating four-pole magnetic fields, the coreless electromagnetic coils 24, 25 for generating six-pole magnetic fields, and the coreless electromagnetic coil 26 for generating two-pole magnetic fields for the purpose of correcting three electrons in the x-direction and y-direction; and it may include suitable correcting coils in accordance with required characteristics.

Figure 6A:
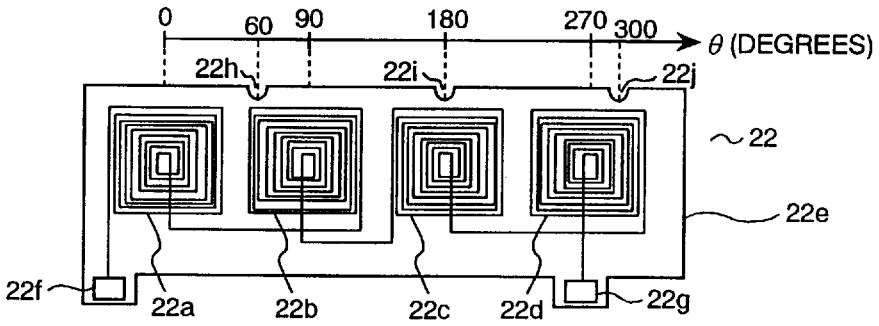
Figure 6B:
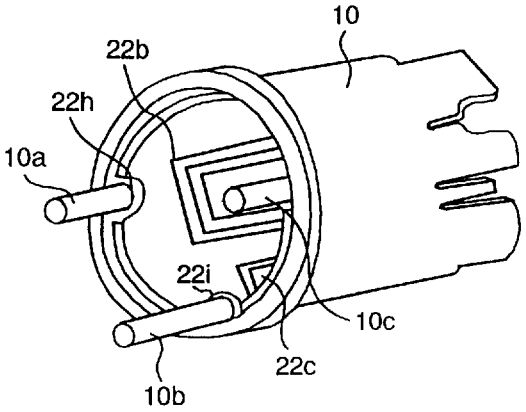
Figure 6C:
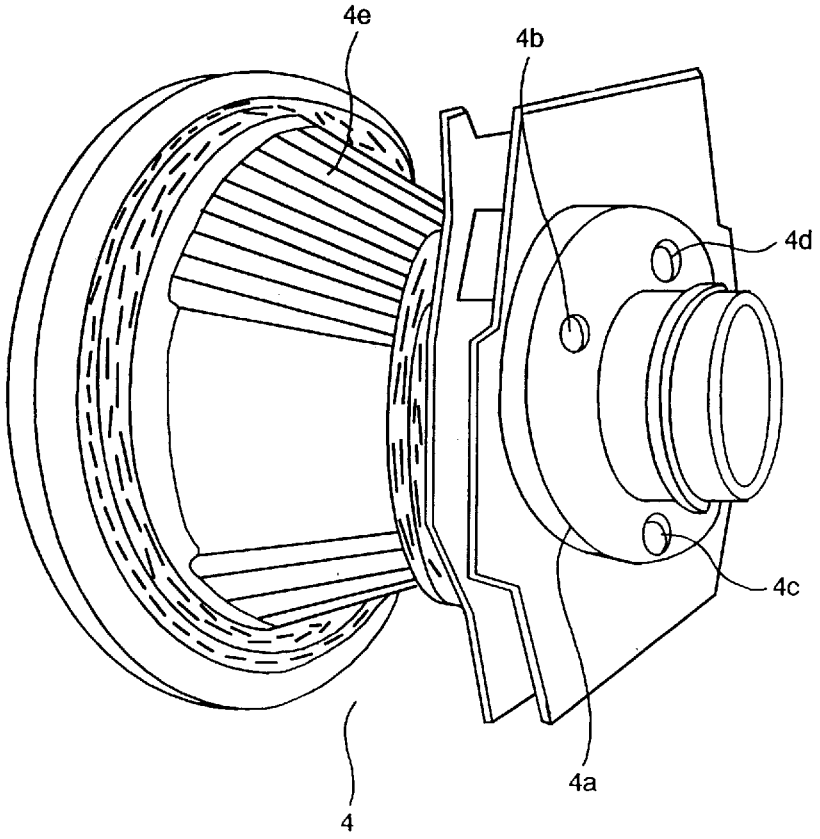

FIGS. 6A to 6C show a second embodiment of the convergence device of the present invention, wherein FIG. 6A is a developed view of a coreless electromagnetic coil for generating four-pole magnetic fields; FIG. 6B is a perspective view of a holder mounting the coreless electromagnetic coil shown in FIG. 6A; and FIG. 6C is a perspective view of a deflection yoke. In these figures, parts corresponding to those in the first embodiment are indicated by the same reference characters, and the overlapped explanation thereof is omitted.

The upper edge (edge on the deflection yoke side) of a non-magnetic supporting film 22*e* of a coreless electromagnetic coil 22 for generating four-pole magnetic field has positioning slots 22*h*, 22*i*, 22*j* formed at angular positions of θ=60, 180, 300°, as shown in FIG. 6A. On the other hand, positioning pins 10*a*, 10*b*, 10*c* to be engaged with the positioning slots 22*h*, 22*i*, 22*j* are provided on the inner surface of a holder 10 at angular positions of θ=60, 180, 300° in such a manner as to extend in the axial direction. A deflection yoke 4 is provided with an insulating separator 4*a* for separating a vertical deflection coil 4*e* from a horizontal deflection coil (not shown). The separator 4*a* has insertion holes 4*b*, 4*c*, 4*d* at angular positions of θ=60, 180, 300°. The positioning pins 10*a*, 10*b*, 10*c* of the holder 10 are respectively inserted in the insertion holes 4*b*, 4*c*, 4*d* for determining the relative angle of the holer 10 with respect to the deflection yoke 4.

When the holder 10 is mounted to the neck portion 3, the convergence device 5 is angularly positioned by insertion of the positioning pins 10*a*, 10*b*, 10*c* into the insertion holes 4*b*, 4*c*, 4*d* of the separator 4*a*. The non-magnetic supporting film 22*e* mounting coil conductors 22*a* to 22*d* of the coreless electromagnetic coil 22 for generating four-pole magnetic fields is mounted to the holder at a specified rotational angle by engagement of the positioning slots 22*h*, 22*i*, 22*j* formed in the upper edge of the supporting film 22*e* with the positioning pins 10*a*, 10*b*, 10*c* of the holder 10 respectively. Accordingly, by arrangement of the coil conductors 22*a* to 22*d* on the non-magnetic supporting film 22*e* in consideration of the above relative rotational positions, it becomes possible to perform accurate convergence adjustment. The other coreless electromagnetic coils 23, 24, 25, 26 described in the first embodiment (see FIG. 4B to 4E) can be also positioned in the same manner as described above.

In the coreless electromagnetic coils 22 to 26, the coil conductor formed of a wound magnet wire may be replaced with a printed coil (conductive foil pattern) fabricated by printing or the like. Moreover, each electromagnetic coil can be effectively formed by winding of one continuous film formed with coil conductors in a plurality of layers.

In the above embodiments, each of the coreless electromagnetic coils 22 to 26 is wound around the neck portion 3 one time; however, it may be wound around the neck portion 3 two or more times for increasing the strengths of generated magnetic fields of the coil. FIGS. 9A to 9E are developed views of coils each being wound around the neck portion 3 two times.

Figure 9A:
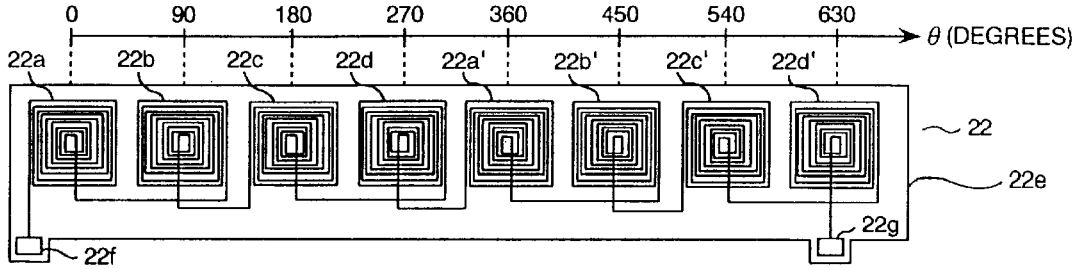
FIGS. 9A to 9E are developed views of modifications of the coreless electromagnetic coils shown in FIGS. 4A to 4E.
Figure 9B:
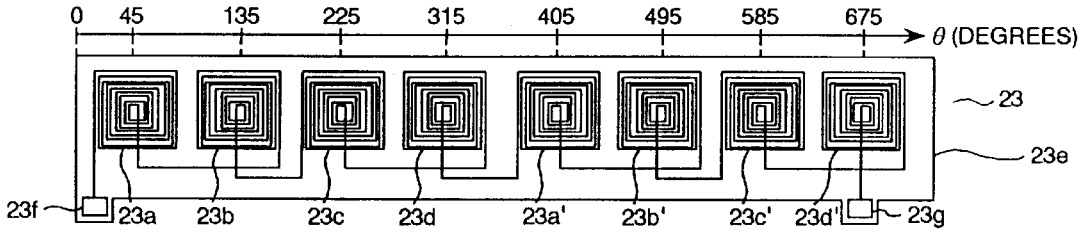

FIGS. 9A, 9B, similar to FIGS. 4A, 4B, show coreless electromagnetic coils 22, 23 for generating four-pole magnetic fields, spiral coil conductors 22*a*' to 22*d*' and 23*a*' to 23*d*' being added to the coils 22 and 23, respectively.

Figure 9C:
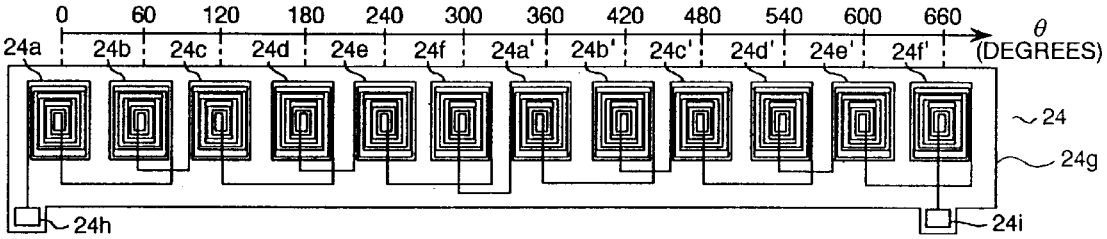
Figure 9D:
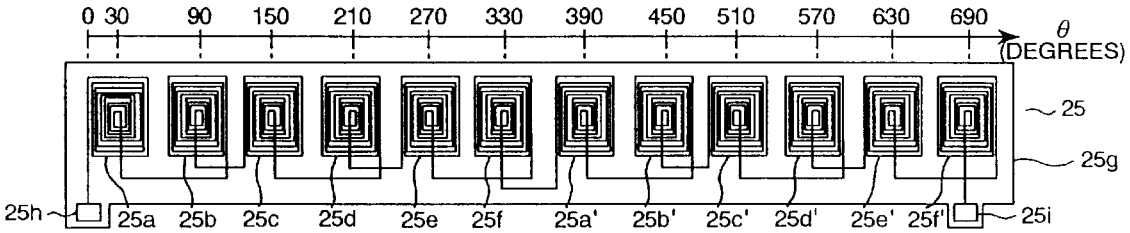

FIGS. 9C, 9D, similar to FIGS. 4C, 4D, show coreless electromagnetic coils 24, 25 for generating six-pole magnetic fields, spiral coil conductors 24*a*' to 24*f*' and 25*a*' to 25*f*' being added to the coils 24 and 25, respectively.

Figure 9E:
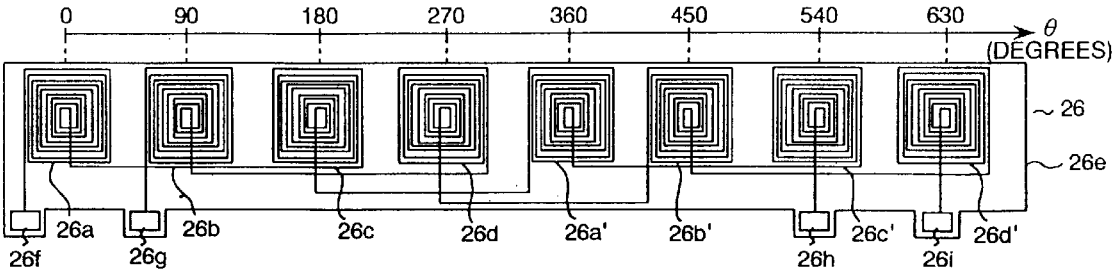

FIGS. 9E, similar to FIG. 4E, shows a coreless electromagnetic coil 26 for generating two-pole magnetic fields, spiral coil conductors 26*a*' to 26*d*' being added to the coil 26.

Next, a third embodiment of the convergence device of the present invention will be described.

Figure 10A:
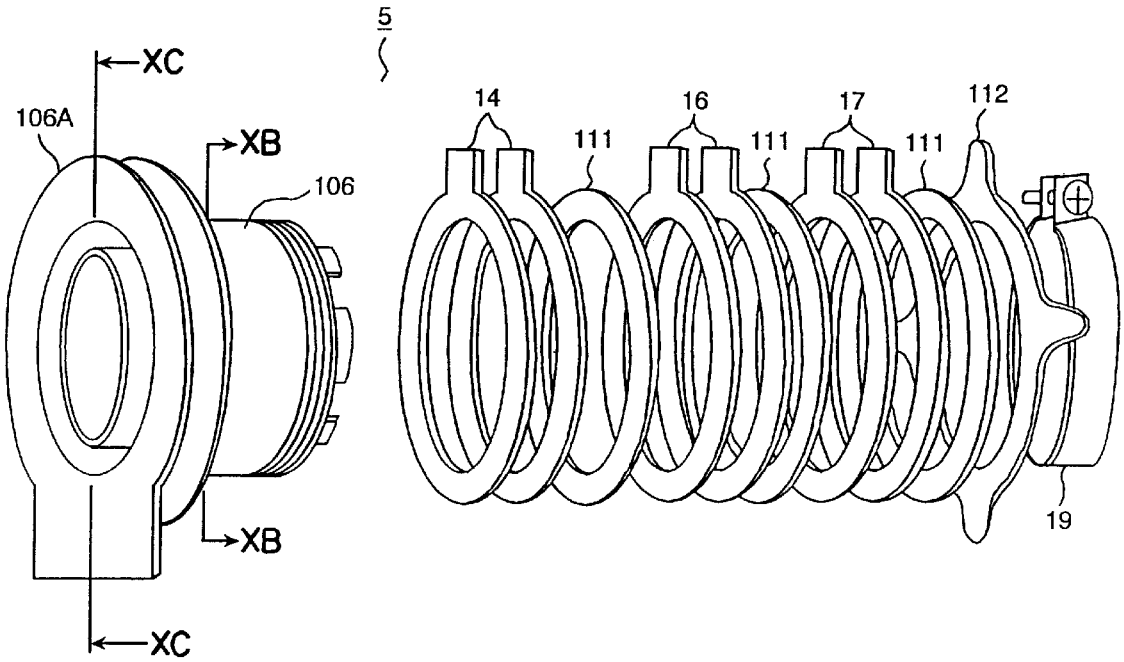
Figure 10B:
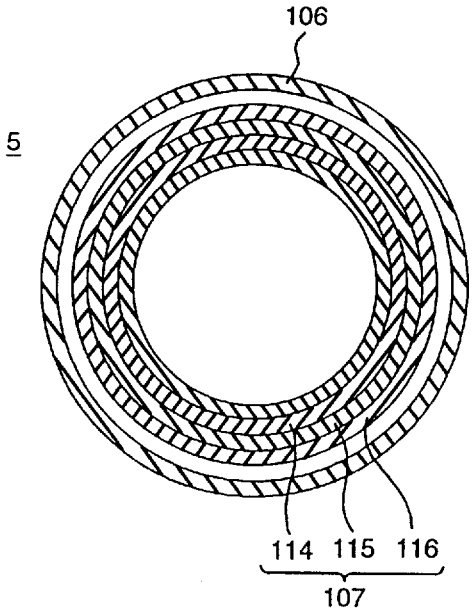
Figure 10C:
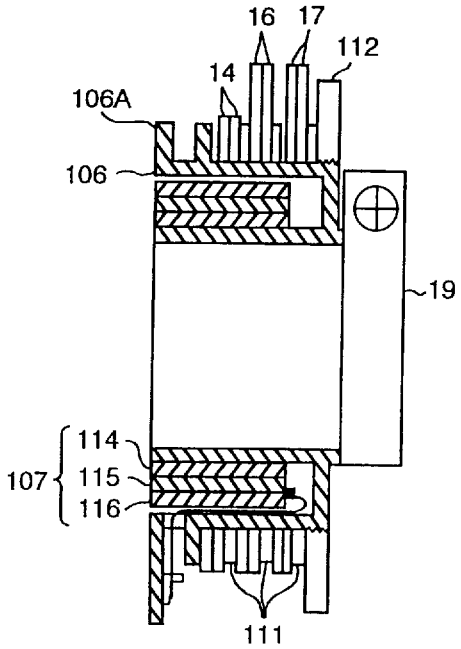

FIGS. 10A to 10C show the configuration of a convergence correction device 5 used for the color cathode ray tube shown in FIG. 1, wherein FIG. 10A is an exploded perspective view of the convergence correction device; FIG. 10B is a sectional view taken along the line XB—XB of FIG. 10A; and FIG. 10C is a sectional view taken along the line XC—XC of the assembled convergence correction device of FIG. 10A.

In FIGS. 10A to 10C, reference numeral 106 indicates a two-layer holder member composed of two insulating cylindrical layers coaxially arranged; 106A is a flange of the holder member 106; 107 is a coil member containing a plurality of printed coils in a flexible film; 14 is a two-pole magnet ring; 16 is a four-pole magnet ring; 17 is a six-pole magnet ring; 111 is a spacer ring; 112 is a securing ring; and 19 is a clamping band.

The two-layer holder member 106 having the flange 106A at one end has a two-layer structure composed of an inner layer and an outer layer in cross-section, and contains the wound coil member 107 in a space between the inner and outer layers. A pair of the two-pole magnet rings 14, the spacer ring 111, a pair of the four-pole magnet rings 16, the spacer ring 111, a pair of the six-pole magnet rings 17, and the securing ring 112 are inserted around the outer surface of the outer layer of the two-layer holder member 106 in this order, followed by insertion of the clamping band 19, and the threaded securing ring 112 is clamped, so that all of the magnet rings are disposed around the outer surface of the outer layer of the two-layer holder member 106 in a semi-fixed state, to thus form the convergence mechanism 5.

Figure 10D:
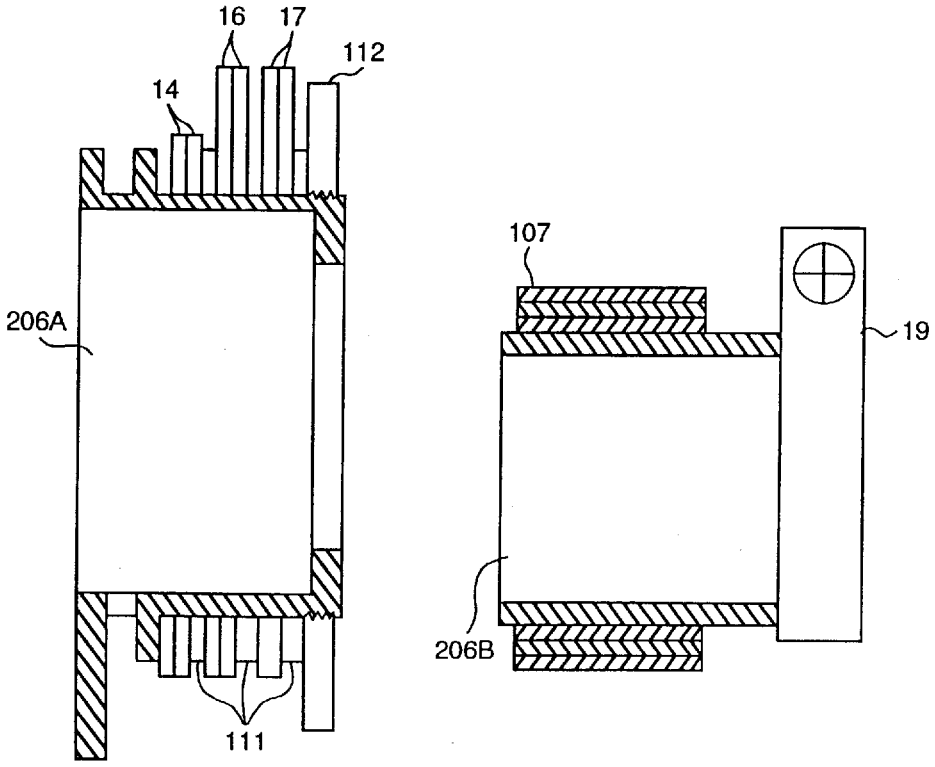
FIG. 10D is an exploded perspective view of a modification of the third embodiment.

The two-layer holder member 106 shown in FIGS. 10A to 10C is constructed so that the inner layer and the outer layer are formed integrally with each other; however, it may be constructed as shown in FIG. 10D, wherein an outer holder 206A and an inner holder 206B are formed separately from each other and the inner holder 206B is detachably inserted in the outer holder 206A. In this case, the coil member 107 is fixed around the outer surface of the inner holder 206B.

Figure 11A:
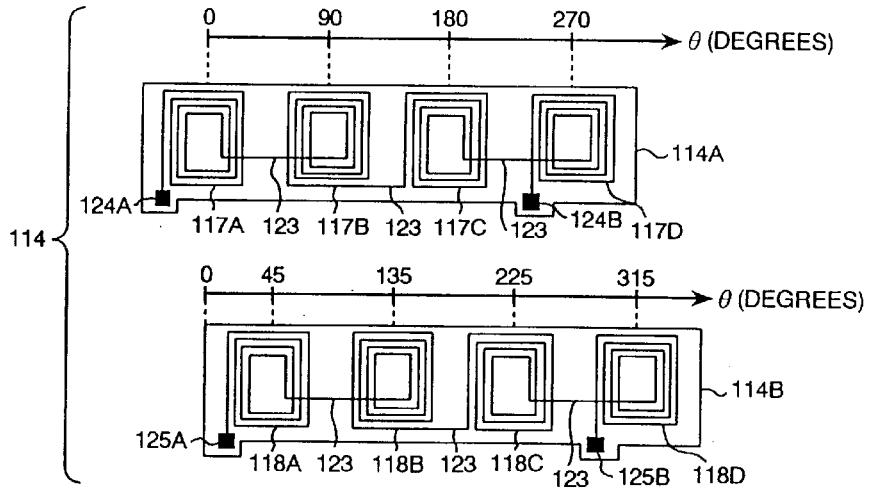
FIGS. 11A to 11C are developed views of arrangement examples of coil members used for the convergence correction device shown in FIGS. 10A to 10D.
Figure 11B:
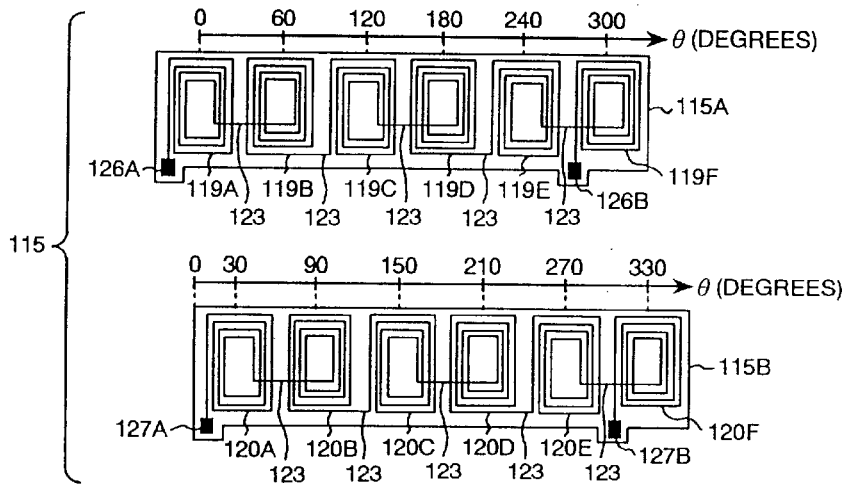
Figure 11C:
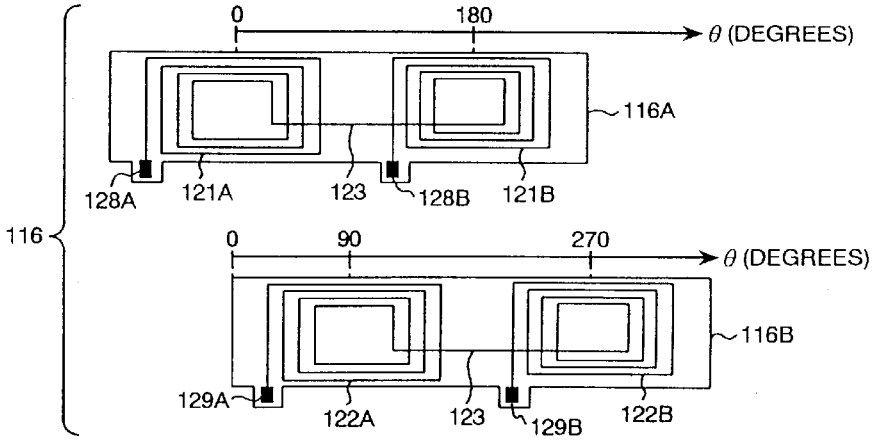

FIGS. 11A to 11C are developed views of examples of the coil members used for the convergence correction device 5 shown in FIGS. 10A to 10C, wherein FIG. 11A shows a coil member for generating four-pole magnetic fields; FIG. 11B shows a coil member for generating six-pole magnetic fields; and FIG. 11C shows a coil member for generating two-pole magnetic fields.

In FIGS. 11A to 11C, reference numeral 114 indicates a coil member for generating four-pole magnetic fields; 114A is a first coil element for generating four-pole magnetic fields; 114B is a second coil element for generating four-pole magnetic fields; 115 is a coil member for generating six-pole magnetic fields; 115A is a first coil element for generating six-pole magnetic fields; 115B is a second coil element for generating six-pole magnetic fields; 116 is a coil member for generating two-pole magnetic fields; 116A is a first coil element for generating two-pole magnetic fields; 116B is a second coil element for generating two-pole magnetic fields; 117A, 117B, 117C, 117D are printed coils contained in the first coil element 114A for generating four-pole magnetic fields, 118A, 118B, 118C, 118D are printed coils contained in the second coil element 114B for generating four-pole magnetic fields; 119A, 119B, 119C, 119D, 119E, 119F are printed coils contained in the first coil element 115A for generating six-pole magnetic fields; 120A, 120B, 120C, 120D, 120E, 120F are printed coils contained in the second coil element 115B for generating six-pole magnetic fields; 121A, 121B are printed coils contained in the first coil element 116A for generating two-pole magnetic fields; 122A, 122B are printed coils contained in the second coil element 116B for generating two-pole magnetic fields; 123 is a conductor for connecting adjacent printed coils to each other; 124A, 124B are connection terminals of the first coil element 114A for generating four-pole magnetic fields; 125A, 125B are connection terminals of the second coil element 114B for generating four-pole magnetic fields; 126A, 126B are connection terminals of the first coil element 115A for generating six-pole magnetic fields; 127A, 127B are connection terminals of the second coil element 115B for generating six-pole magnetic fields; 128A, 128B are connection terminals of the first coil element 116A for generating two-pole magnetic fields; and 129A, 129B are connection terminals of the second coil element 116B for generating two-pole magnetic fields.

The coil member 114 for generating four-pole magnetic fields includes the first coil element 114A comprising the printed coils 117A to 117D for generating four-pole magnetic fields and the second coil element 114B comprising 118A to 118D for generating four-pole magnetic fields which are stacked in one flexible film. The coil member 115 for generating six-pole magnetic fields includes the first coil element 115A comprising the printed coils 119A to 119F for generating six-pole magnetic fields and the second coil element 115B comprising the printed coils 120A to 120F for generating six-pole magnetic fields which are stacked in one flexible film. The coil member 116 for generating two-pole magnetic fields includes the first coil element 116A comprising the printed coils 121A and 121B for generating two-pole magnetic fields and the second coil element 116B comprising the printed coils 122A and 122B for generating two-pole magnetic fields which are stacked in one flexible film.

Figure 12A:
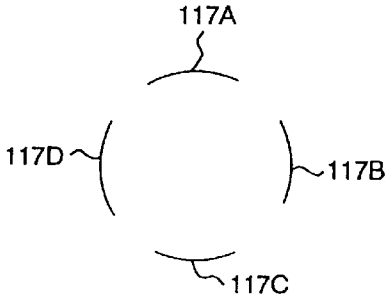
FIGS. 12A to 12F are diagrams showing angular positions of printed coils of the coil members shown in FIGS. 11A to 11C.
Figure 12B:
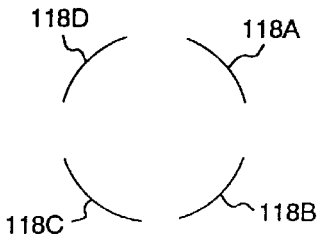
Figure 12C:
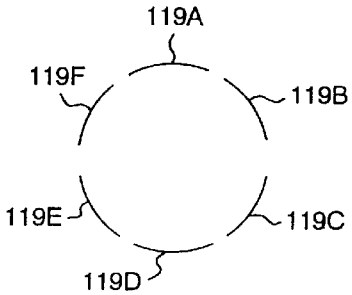
Figure 12D:
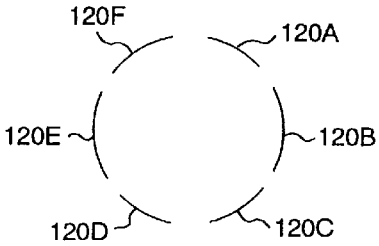
Figure 12E:
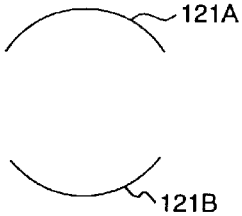
Figure 12F:
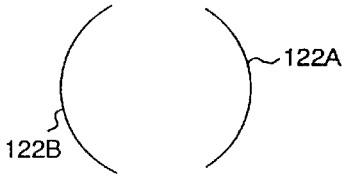

The mounting of the convergence correction device 5 around the neck portion of a color cathode ray tube will be described below. Here, it is assumed that the vertical direction on the panel portion 1 of the color cathode ray tube is taken as 0° and the clockwise angle therefrom is taken as θ°. The first coil element 114A for generating four-pole magnetic fields is configured such that the printed coils 117A, 117B, 117C, 117D are respectively located at angular positions of θ=0, 90, 180, 270°, as shown in FIG. 12A. The second coil element 114B for generating four-pole magnetic fields is configured such that the printed coils 118A, 118B, 118C, 118D are respectively located at angular positions of θ=45, 135, 225, 315°, as shown in FIG. 12B. The first coil element 115A for generating six-pole magnetic fields is configured such that the printed coils 119A, 119B, 119C, 119D, 119E, 119F are respectively located at angular positions of θ=0, 60, 120, 180, 240, 300°, as shown in FIG. 12C. The second coil element 115B for generating six-pole magnetic fields is configured such that the printed coils 120A, 120B, 120C, 120D, 120E, 120F are respectively located at angular positions of θ=30, 90, 150, 210, 270, 330°, as shown in FIG. 12D. The first coil element 116A for generating two-pole magnetic fields is configured such that the printed coils 121A, 121B are respectively located at angular positions of θ=0, 180°, as shown in FIG. 12E. The second coil element 116B for generating two-pole magnetic fields is configured such that the printed coils 122A, 122B are respectively located at angular positions of θ=90, 270°, as shown in FIG. 12F.

In the first and second coil elements 114A, 114B for generating four-pole magnetic fields, the first and second coil elements 115A, 115B for generating six-pole magnetic fields, and the first and second coil elements 116A, 116B for generating two-pole magnetic fields, adjacent printed coils are connected to each other by means of each conductor 123 in the flexible film. Referring to FIG. 11A, the first coil element 114A for generating four-pole magnetic fields includes the connection terminal 124A connected to one end of the printed coil 117A and the connection terminal 124B connected to one end of the printed coil 117D; while the second coil element 114B for generating four-pole magnetic fields includes the connection terminal 125A connected to one end of the printed coil 118A and the connection terminal 125B connected to one end of the printed coil 118D. Referring to FIG. 11B, the first coil element 115A for generating six-pole magnetic fields includes the connection terminal 126A connected to one end of the printed coil 119A and the connection terminal 126B connected to one end of the printed coil 119F; while the second coil element 115B for generating six-pole magnetic fields includes the connection terminal 127A connected to one end of the printed coil 120A and the connection terminal 127B connected to one end of the printed coil 120F. Referring to FIG. 11C, the first coil element 116A for generating two-pole magnetic fields includes the connection terminal 128A connected to one end of the printed coil 121A and the connection terminal 128B connected to one end of the printed coil 121B; while the second coil element 116B for generating two-pole magnetic fields includes the connection terminal 129A connected to one end of the printed coil 122A and the connection terminal 129B connected to one end of the printed coil 122B.

The convergence correction using the convergence correction device 5 having the above configuration will be described below.

The magnet rings inserted around the outer surface of the outer layer of the two-layer holder member 106 is set as follows: The relative rotational angles between a pair of four-pole magnet rings 16 and between a pair of six-pole magnet rings 17 are adjusted to obtain desired magnetic field strengths, and the collective rotational angles of a pair of the four-pole magnet rings 16 and a pair of the six-pole magnet rings 17 are adjusted to obtain the desired directions of the generated magnetic fields, thereby achieving the static convergence of three electron beams of blue, green and blue; the relative rotational angle between a pair of two-pole magnet rings 14 is adjusted to obtain desired magnetic field strengths, and the collective rotational angles of a pair of the two-pole magnet rings 16 are adjusted to obtain the desired directions of the generated magnetic fields, thereby achieving a color purity. The magnet rings can be fixed at a specified adjustment state by clamping the securing ring 112 after adjustment of a pair of the four-pole magnet rings 16, a pair of the six-pole magnet rings 17, and a pair of two-pole magnet rings 14.

As shown in FIG. 10C, the coil member 114 formed as one wound flexible film for generating four-pole magnetic fields, the coil member 115 formed as one wound flexible film for generating six-pole magnetic fields, and the coil member 116 formed as one wound flexible film for generating two-pole magnetic fields, are sequentially inserted in a stacked state between the inner layer and the outer layer of the two-layer holder member 106.

The coil member 114 for generating four-pole magnetic fields is oriented such that the printed coils 117A to 117D of the first coil element 114A for generating four-pole magnetic fields are disposed at the angular positions shown in FIG. 12A while the printed coils 118A to 118D of the second coil element 114B for generating four-pole magnetic fields are disposed at the angular positions shown in FIG. 12B. In such a state, by supply of a correction current modulated in synchronization with horizontal and vertical deflections of three electron beams of B, G, R to the first coil element 114A through the connection terminals 124A and 124B, the magnetic fields shown in FIG. 5A are generated to move the left side electron beam B (for blue) upward in the vertical direction, and the right side electron beam R (for red) downward in the vertical direction. Similarly, by supply of a correction current modulated in synchronization with horizontal and vertical deflections of three electron beams of B, G, R to the second coil element 114B through the connection terminals 125A and 125B, the magnetic fields shown in FIG. 5B are generated to move the left side electron beam B (for blue) and the right side electron beam R (for red) toward the center electron beam G (for green), that is, toward the positive and negative x-axes, respectively.

The coil member 115 for generating six-pole magnetic fields is oriented such that the printed coils 119A to 119F of the first coil element 115A for generating six-pole magnetic fields are disposed at the angular positions shown in FIG. 12C while the printed coils 120A to 120F of the second coil element 115B for generating six-pole magnetic fields are disposed at the angular positions shown in FIG. 12D. In such a state, by supply of a correction current modulated in synchronization with horizontal and vertical deflections of three electron beams of B, G, R to the first coil element 115A through the connection terminals 126A and 126B, the magnetic fields shown in FIG. 5C are generated to move the left side electron beam B (for blue) toward the center electron beam G (for green), that is, rightward in the horizontal direction, and to move the right side electron beam R (for red) away from the center electron beam G (for green), that is, rightwatd in the horizontal direction. Similarly, by supply of a correction current modulated in synchronization with horizontal and vertical deflections of three electron beams of B, G, R to the second coil element 115B through the connection terminals 127A and 127B, the magnetic fields shown in FIG. 5D are generated to move the left side electron beam B (for blue) and the right side electron beam R (for red) downward in the vertical direction. Such movements of the left side electron beam B (for blue) and the right side electron beam R (for red) by the coil member 114 for generating four-pole magnetic fields and the coil member 115 for generating six-pole magnetic fields eliminate an convergence error over the entire phosphor screen and hence to provide a high quality display image.

Figure 5F:
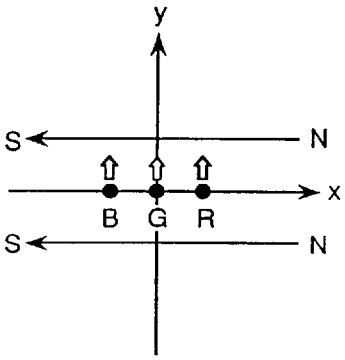

The coil member 116 for generating two-pole magnetic fields is oriented such that the printed coils 121A, 121B of the first coil element 116A for generating two-pole magnetic fields are disposed at the angular positions shown in FIG. 12E while the printed coils 122A, 122B of the second coil element 116B for generating two-pole magnetic fields are disposed at the angular positions shown in FIG. 12F. In such a state, by supply of a correction current to the first coil element 116A through the connection terminals 128A and 128B, the magnetic fields shown in FIG. 5E are generated to move the left side electron beam B (for blue), the center electron beam G (for green) and the right side electron beam R (for red) leftward in the horizontal direction. Similarly, by supply of a correction current to the second coil element 116B through the connection terminals 129A and 129B, the magnetic fields shown in FIG. 5F are generated to move the left side electron beam B (for blue), the center electron beam G (for green) and the right side electron beam R (for red) upward in the vertical direction. Such movements of the left side electron beam B (for blue), the center electron beam G (for green) and the right side electron beam R (for red) by the coil member 116 for generating two-pole magnetic fields achieve a color purity over the entire phosphor screen and hence to provide a high quality display image. The degradation in color purity can be simply readjusted by adjustment of the correction current to be supplied to the coil member 116 for generating two-pole magnetic fields.

Figure 13:
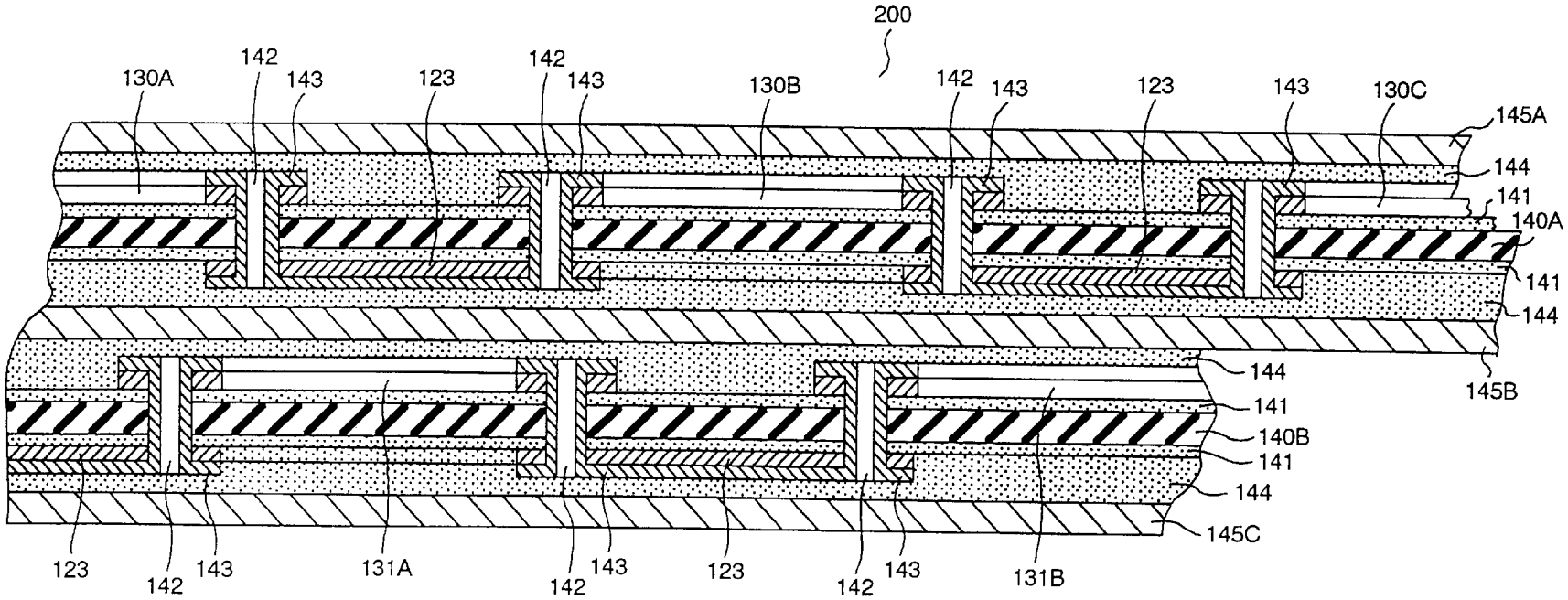
FIG. 13 is a sectional view showing an arrangement example of adjacent printed coils and connection conductors connecting the printed coils to each other.

FIG. 13 is a sectional view showing one arrangement example of printed spiral coils and connection conductors connecting adjacent printed coils to each other.

Referring to FIG. 13, reference numerals 130A, 130B, 130C indicate printed spiral coils disposed on the upper layer; and 131A, 131B indicate printed spiral coils disposed on the lower layer. In addition, parts corresponding to those shown in FIGS. 11A to 11C are indicated by the same reference characters.

The printed coils 130A, 130B, 130C are disposed on the upper layer in one flexible film 200, and the printed coils 131A, 131B are disposed on the lower layer in the same flexible film 200. The printed coil 130A is connected to the adjacent printed coil 130B by means of the connection conductor 123, and the printed coil 130B is connected to the adjacent printed coil 130C by means of the connection conductor 123. The printed coil 131A is connected to the adjacent printed coil 131B by means of the connection conductor 123. In this case, as shown in FIG. 13, the connection conductors 123 are disposed at positions lower than those of the printed coils 130A, 130B, 130C, 131A, 131B in the flexible film 200; accordingly, the film-like coil member, substantially, has a four layer structure of two layers of printed coils and two layers of connection conductors.

With this structure, plural sets of printed coils (for example, one set of 130A to 130C; and the other set of 131A, 131B) can be stacked in one flexible film in such a manner as to be insulated from each other, and the adjacent printed coils in each set (for example, printed coils 130A and 130B, 130B and 130C in one set; printed coils 131A and 131B in the other set) can be electrically connected to each other by means of the connection conductors 123.

Referring to FIG. 13, each of the printed coils 130A, 130B, 130C (copper foil having a thickness of 18 $\mu$m) is bonded on the upper surface of a base film 140A (polyimide having a thickness of 25 $\mu$m) through an adhesive 141, and each connection conductor 123 (copper foil having a thickness of 18 $\mu$m) is bonded on the lower surface of the base film 140A through the adhesive 141. For example, the printed coils 130A and 130B are electrically connected to the connection conductor 123 by means of a copper plating layer 143 (thickness: 18 $\mu$m) by way of a though-hole 142. The upper surface of the base film 140A is further covered with a polyimide film 145A (thickness: 25 $\mu$m) through an adhesive 144, while the lower surface of the base film 140A is further covered with a polyimide film 145B (thickness: 25 $\mu$m) through the adhesive 144.

On the other hand, each of the printed coils 131A, 131B (copper foil having a thickness of 18 $\mu$m) on the lower layer is bonded on the upper surface of a base film 140B (polyimide having a thickness of 25 $\mu$m) through the adhesive 141, and the connection conductor 123 (copper foil having a thickness of 18 $\mu$m) is bonded on the lower surface of the base film 140B through the adhesive 141. For example, the printed coils 131A and 131B are electrically connected to the connection conductor 123 by means of the copper plating layer 143 (thickness: 18 $\mu$m) by way of the though-hole 142. The upper surface of the base film 140B is further bonded on the above polyimide film 145B through the adhesive 144 while the lower surface of the base film 140B is covered with a polyimide film 145C through the adhesive 144.

Additionally, in the configuration shown in FIG. 13, by making common the adhesive 144 on the lower side of the polyimide film 140A and the adhesive 144 on the upper side of the polyimide film 140B, the film 145B can be omitted.

Figure 14:
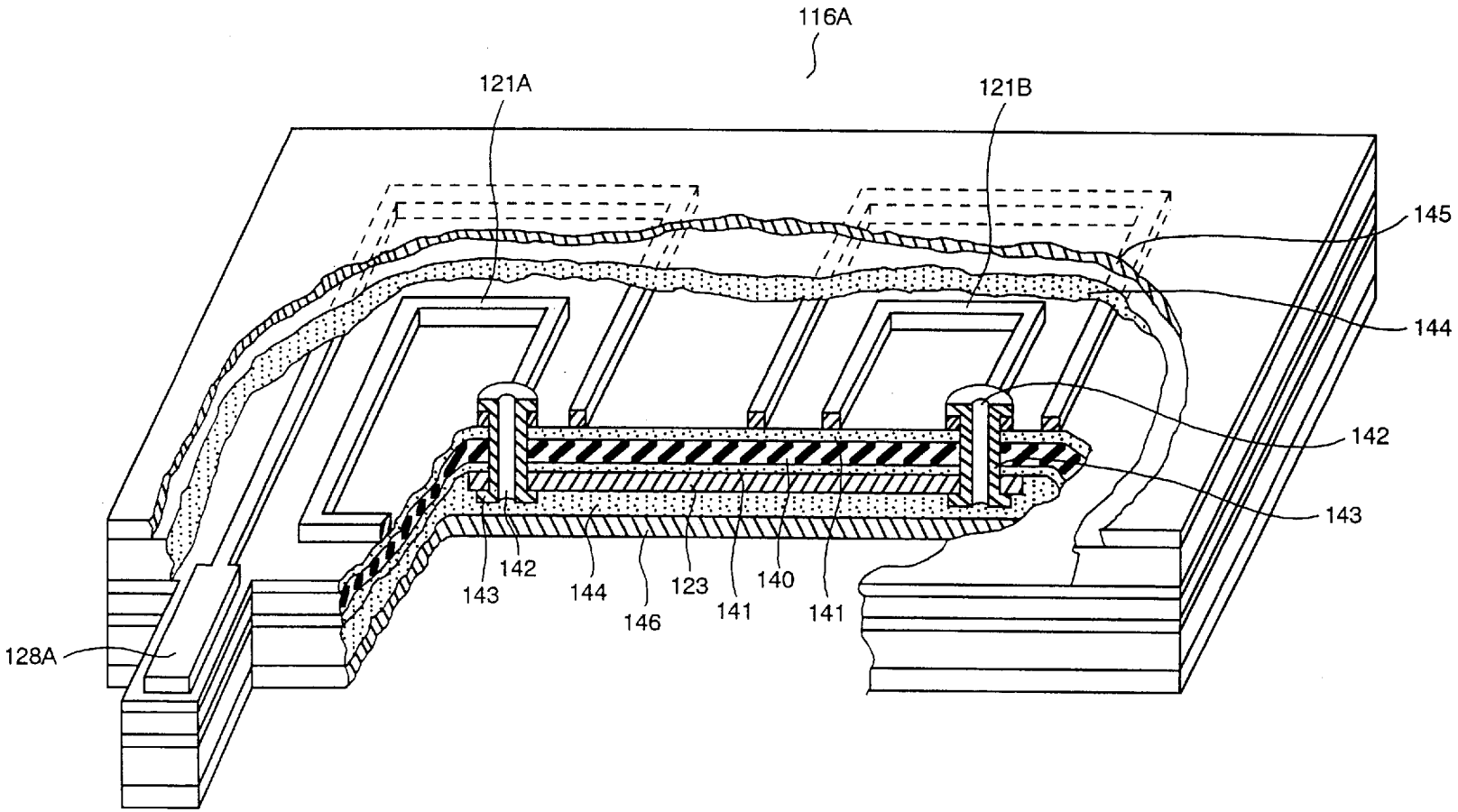
FIG. 14 is a perspective view of an essential portion of a coil element for generating two-pole magnetic fields, with portions cut away.

FIG. 14 is a perspective view, with parts cutaway, of an essential portion of the first coil element 116A for generating two-pole magnetic fields for the purpose of illustrating more fully the arrangement example of the adjacent printed coils and the connection conductors for connection thereof. Referring to FIG. 14, the printed coils 121A, 121B (copper foil having a thickness of 18 $\mu$m) are bonded on the upper surface of a polyimide base film 140 (thickness: 25 $\mu$m) through an adhesive 141; while the connection conductor 123 (copper foil having a thickness of 18 $\mu$m) is disposed on the lower surface of the base film 140 through the adhesive 141. The printed coils 121A, 121B are electrically connected to the connection conductor 123 by means of a copper plating layer 143 (thickness of 18 $\mu$m) by way of a through-hole 142. The printed coils 121A, 121B are covered with a polyimide film 145 (thickness of 25 $\mu$m) through an adhesive 144 while the connection conductor 123 is covered with a polyimide film 146 through the adhesive 144. The connection terminal 128A connected to one end of the printed coil 121A is formed.

The arrangement example shown in FIG. 14 has only one layer of the first coil element 116A for generating two-pole magnetic fields; however, as shown in FIG. 13, the second coil element 116B for generating two-pole magnetic fields may be stacked thereon, and further, for example, the coil elements 114A, 114B, 115A, 115B for generating four-pole magnetic elements and six-pole magnetic elements may be similarly stacked thereon.

As described above, the convergence correction device 5 in this embodiment exhibits a feature that the coil member 107 inserted between the outer layer and the inner layer of the two-coaxially-cylindrical-layer holder member 106 is so constructed that plural sets of printed coils for generating magnetic fields having an even number of poles are stacked in a flexible film in such a manner as to be insulated from each other. This is advantageous in minimizing the thickness of the flexible film itself. For example, the flexible film can be wound around the neck portion 3 of a color cathode ray tube with the thickness sufficiently reduced as compared with the known flexible support which has been wound together with an electrically insulating film.

The convergence correction device 5 in this embodiment exhibits another feature that all printed coils are contained in the flexible film and thereby they are never brought in contact with other components. This is advantageous in eliminating the necessity of winding the flexible film having printed coils together with an electrically insulating film unlike the known flexible coil, and in eliminating an extra labor for mounting the convergence correction device 5. A further advantage of the convergence correction device 5 is that the flexible film as the coil member 107 can be simply positioned in the two-layer holder member 106 only by insertion between the outer layer and the inner layer of the two-layer holder member 106.

Although in the above embodiments the convergence correction device 5 includes a combination of the coil member 114 for generating four-pole magnetic fields, the coil member 115 for generating six-pole magnetic fields and the coil member 116 for generating two-pole magnetic fields, the present invention is not limited thereto. For example, the convergence correction device 5 of the present invention may include at least one of the above coil members, that is, only the coil member 114 for generating four-pole magnetic fields; only the coil members 115 for generating six-pole magnetic fields; only the coil members 116 for generating two-pole magnetic fields; the combination of the coil members 114 and 115; the combination of the coil members 114 and 116; or the combination of the coil members 115 and 116.

In addition, although in the above embodiments each of the combinations of the first and second coil elements 114A, 114B for generating four-pole magnetic fields, of the first and second coil elements 115A, 115B for generating six-pole magnetic fields, and of the first and second coil elements 116A, 116B for generating two-pole magnetic fields is stacked in one flexible film, respectively, the present invention is not limited thereto. For example, the first and second coil elements 114A, 114B for generating four-pole magnetic fields may be stacked in one flexible film together with the first and second coil elements 115A, 115B for generating six-pole magnetic fields; the first and second coil elements 114A, 114B for generating four-pole magnetic fields may be stacked in one flexible film together with the first and second coil elements 116A, 116B for generating two-pole magnetic fields; the first and second coil elements 115A, 115B for generating six-pole magnetic fields may be stacked in one flexible film together with the first and second coil elements 116A, 116B for generating two-pole magnetic fields; or all of the coil elements 114A, 114B, 115A, 115B, 116A, 116B may be stacked in one flexible film.

According to the cathode ray tube display system of the present invention an electromagnetic coil of the convergence device is mounted on a neck portion of a cathode ray tube in the form of a coreless electromagnetic coil formed by cylindrically stacking spiral coil conductors supported on a non-magnetic insulator, and accordingly a distance between the electromagnetic coil and an electron beam is made shorter and thereby the convergence device can be operated with a weak magnetic field. This is effective to reduce the adverse effect exerted on a magnetic field generated by a deflection yoke, and to make smaller a drive circuit. Accordingly, a high performance cathode ray tube display system can be obtained at a low cost by the addition of a dynamic convergence device to a standardized cathode ray tube display which provides substantial convergence of the three beams and color purity with an optimized deflection yoke and permanent magnets without the need for any dynamic convergence device.

What is claimed is:

1. A color cathode ray tube comprising:

an evacuated envelope including a panel portion, a neck portion, and a funnel portion connecting said panel portion to said neck portion;

a phosphor screen formed on an inner surface of said panel portion;

a color selection electrode disposed spaced from said phosphor screen in said panel portion;

an in-line electron gun contained in said neck portion, for generating one center electron beam and two side electron beams and directing said center and side electron beams toward said phosphor screen;

a deflection device mounted in the vicinity of a junction between said neck portion and said funnel portion, for deflecting said three electron beams in horizontal and vertical directions and self-converging said three electron beams;

static beam convergence means comprising permanent magnets and mounted on said neck portion, for generating magnetic fields adjustable to converge said three electron beams at a central portion of said phosphor screen; and a dynamic beam convergence means comprising coreless electromagnetic coils, mounted on said neck portion, for generating magnetic fields adjustable to converge said three electron beams at peripheral portions of said phosphor screen;

wherein said dynamic beam convergence means comprises at least a third electromagnetic coil means for generating an adjustable magnetic field to move said three electron beams in a same direction.

2. A color cathode ray tube according to claim 1, wherein said dynamic beam convergence means comprises:

a first electromagnetic coil means for generating an adjustable magnetic field to move said two side electron beams in opposite directions;

a second electromagnetic coil means for generating an adjustable magnetic field to move said two side electron beams in a same direction; and a third electromagnetic coil means for generating an adjustable magnetic field to move said three electron beams in a same direction.

3. A color cathode ray tube according to claim 1, wherein said dynamic beam convergence means comprises:

a first electromagnetic coil means for generating an adjustable magnetic field to move said two side electron beams in opposite directions; and a second electromagnetic coil means for generating an adjustable magnetic field to move said two side electron beams in a same direction.

4. A color cathode ray tube according to claim 1, wherein said dynamic beam convergence means comprises:

a second electromagnetic coil means for generating an adjustable magnetic field to move said two side electron beams in a same direction; and a third electromagnetic coil means for generating an adjustable magnetic field to move said three electron beams in a same direction.

5. A color cathode ray tube according to claim 1, wherein said dynamic beam convergence means comprises:

a first electromagnetic coil means for generating an adjustable magnetic field to move said two side electron beams in opposite directions; and a third electromagnetic coil means for generating an adjustable magnetic field to move said three electron beams in a same direction.

6. A color cathode ray tube according to claim 1, wherein said dynamic beam convergence means comprises at least a first electromagnetic coil means for generating an adjustable magnetic field to move said two side electron beams in opposite directions.

7. A color cathode ray tube according to claim 1, wherein said dynamic beam convergence means comprises at least a second electromagnetic coil means for generating an adjustable magnetic field to move said two side electron beams in a same direction.

8. A color cathode ray tube according to claim 1, wherein said dynamic beam convergence means comprises at least a first electromagnetic coil means for generating four-pole magnetic fields.

9. A color cathode ray tube according to claim 1, wherein said dynamic beam convergence means comprises at least a second electromagnetic coil means for generating six-pole magnetic fields.

10. A color cathode ray tube according to claim 1, wherein said dynamic beam convergence means comprises at least a third electromagnetic coil means for generating two-pole magnetic fields.

11. A color cathode ray tube according to claim 1, wherein said coreless electromagnetic coils are formed of spiral coil conductors supported by a non-magnetic insulator mounted around an outer surface of said neck portion.

12. A color cathode ray tube according to claim 1, wherein said dynamic beam convergence means comprises:

a first electromagnetic coil means for generating four-pole magnetic fields;

a second electromagnetic coil means for generating six-pole magnetic fields; and a third electromagnetic coil means for generating two-pole magnetic fields.

13. A color cathode ray tube according to claim 1, wherein said dynamic beam convergence means comprises:

a first electromagnetic coil means for generating four-pole magnetic fields; and a second electromagnetic coil means for generating six-pole magnetic fields.

14. A color cathode ray tube according to claim 1, wherein said dynamic beam convergence means comprises:

a second electromagnetic coil means for generating six-pole magnetic fields; and a third electromagnetic coil means for generating two-pole magnetic fields.

15. A color cathode ray tube according to claim 1, wherein said dynamic beam convergence means comprises:

a first electromagnetic coil means for generating four-pole magnetic fields; and a third electromagnetic coil means for generating two-pole magnetic fields.

16. A color cathode ray tube according to claim 1, wherein said dynamic beam convergence means comprises plural sets of coreless electromagnetic spiral coils supported by a non-magnetic insulator, said coreless electromagnetic coils being mounted in a stacked state on said neck portion.

17. A color cathode ray tube according to claim 16, wherein plural sets of said coreless electromagnetic coils are disposed between said static beam convergence means and said neck portion.

18. A color cathode ray tube according to claim 11, wherein said spiral coil conductors are formed of magnet wires.

19. A color cathode ray tube according to claim 11, said spiral coil conductors are formed of conductive foils on a non-magnetic film made of an insulating resin.

20. A color cathode ray tube according to claim 19, wherein said spiral coil conductors are wound around said neck portion in a plurality of layers.

21. A color cathode ray tube according to claim 20, wherein said spiral coil conductors of a same kind are wound around said neck portion in a plurality of layers.

22. A color cathode ray tube according to claim 1, wherein said dynamic beam convergence means includes a means for engaging with said deflection device for positioning said dynamic beam convergence means in a rotational direction around the axis thereof.

23. A color display system comprising a color cathode ray tube and a dynamic beam convergence power supply means, said color cathode ray tube comprising:

an evacuated envelope including a panel portion, a neck portion, and a funnel portion connecting said panel portion to said neck portion;

a phosphor screen formed on an inner surface of said panel portion;

a color selection electrode disposed spaced from said phosphor screen in said panel portion;

an in-line electron gun contained in said neck portion, for generating one center electron beam and two side electron beams and directing said three electron beams toward said phosphor screen;

a deflection device mounted in the vicinity of a junction between said neck portion and said funnel portion, for deflecting said three electron beams in horizontal and vertical directions and self-converging said three electron beams;

a static beam convergence means comprising permanent magnets, mounted on said neck portion, for generating an adjustable magnetic field to converge said three electron beams at a central portion of said phosphor screen; and a dynamic beam convergence means comprising coreless electromagnetic coils, mounted on said neck portion, for generating a magnetic field adjustable to converge said three electron beams at peripheral portions of said phosphor screen;

wherein said dynamic beam convergence power supply means supplies correction currents in synchronization with deflection of said three electron beams to said dynamic beam convergence means; and wherein said dynamic beam convergence means comprises at least a third electromagnetic coil means for generating an adjustable magnetic field to move said three electron beams in a same direction.

24. A color display system according to claim 23, wherein said dynamic beam convergence means comprises:

a first electromagnetic coil means for generating an adjustable magnetic field to move said two side electron beams in opposite directions;

a second electromagnetic coil means for generating an adjustable magnetic field to move said two side electron beams in a same direction; and a third electromagnetic coil means for generating an adjustable magnetic field to move said three electron beams in a same direction.

25. A color display system according to claim 23, wherein said dynamic beam convergence means comprises:

a first electromagnetic coil means for generating an adjustable magnetic field to move said two side electron beams in opposite directions; and a second electromagnetic coil means for generating an adjustable magnetic field to move said two side electron beams in a same direction.

26. A color display system according to claim 23, wherein said dynamic beam convergence means comprises:

a second electromagnetic coil means for generating an adjustable magnetic field to move said two side electron beams in a same direction; and a third electromagnetic coil means for generating an adjustable magnetic field to move said three electron beams in a same direction.

27. A color display system according to claim 23, wherein said dynamic beam convergence means comprises:

a first electromagnetic coil means for generating an adjustable magnetic field to move said two side electron beams in opposite directions; and a third electromagnetic coil means for generating an adjustable magnetic field to move said three electron beams in a same direction.

28. A color display system according to claim 23, wherein said dynamic beam convergence means comprises at least a first electromagnetic coil means for generating an adjustable magnetic field to move said two side electron beams in opposite directions.

29. A color display system according to claim 23, wherein said coreless electromagnetic coils are formed of spiral coil conductors supported by a non-magnetic insulator mounted around the outer surface of said neck portion.

30. A color display system according to claim 23, wherein said dynamic beam convergence means comprises:

a first electromagnetic coil means for generating four-pole magnetic fields;

a second electromagnetic coil means for generating six-pole magnetic fields; and a third electromagnetic coil means for generating two-pole magnetic fields.

31. A color display system according to claim 23, wherein said dynamic beam convergence means comprises:

a first electromagnetic coil means for generating four-pole magnetic fields; and a second electromagnetic coil means for generating six-pole magnetic fields.

32. A color display system according to claim 23, wherein said dynamic beam convergence means comprises:

a second electromagnetic coil means for generating six-pole magnetic fields; and a third electromagnetic coil means for generating two-pole magnetic fields.

33. A color display system according to claim 23, wherein said dynamic beam convergence means comprises:

a first electromagnetic coil means for generating four-pole magnetic fields; and a third electromagnetic coil means for generating two-pole magnetic fields.

34. A color display system according to claim 23, wherein said dynamic beam convergence means comprises at least a first electromagnetic coil means for generating four-pole magnetic fields.

35. A color display system according to claim 23, wherein said dynamic beam convergence means comprises at least a second electromagnetic coil means for generating six-pole magnetic fields.

36. A color display system according to claim 23, wherein said dynamic beam convergence means comprises at least a third electromagnetic coil means for generating two-pole magnetic fields.

37. A color display system according to claim 23, wherein said dynamic beam convergence means comprises at least a second electromagnetic coil means for generating an adjustable magnetic field to move said two side electron beams in a same direction.

38. A color display system according to claim 23, wherein said dynamic beam convergence means comprises plural sets of spiral coreless electromagnetic coils supported by a non-magnetic insulator, said coreless electromagnetic coils being mounted in a stacked state on said neck portion.

39. A color display system according to claim 38, wherein plural sets of said coreless electromagnetic coils are disposed between said static beam convergence means and said neck portion.

40. A color display system according to claim 29, wherein said spiral coil conductors are formed of magnet wires.

41. A color display system according to claim 29, wherein said spiral coil conductors are formed of conductive foils on a non-magnetic film made of an insulating resin.

42. A color display system according to claim 41, wherein said spiral coil conductors are wound around said neck portion in a plurality of layers.

43. A color display system according to claim 42, wherein said spiral coil conductors of a same kind are wound around said neck portion in a plurality of layers.

44. A color display system according to claim 23, wherein said dynamic beam convergence means includes a means for engaging with said deflection device for positioning said dynamic beam convergence means in a rotational direction around the axis thereof.

45. A color cathode ray tube provided with a convergence correction device provided in a neck portion of said color cathode ray tube, said convergence correction device comprising:

two cylindrical holder members having large and small diameters, made of an insulating material, held in such a manner as to be coaxial and overlapped on each other; and a coil member including a plurality of printed coils for generating magnetic fields having an even number of poles contained in a flexible film, said coil member being disposed between said two cylindrical holder members having large and small diameters, respectively;

wherein a plurality of said printed coils are stacked in said flexible film in such a manner as to be insulated from each other; and printed coils adjacent to each other and having a same diameter are electrically connected to each other in said flexible film.

46. A color cathode ray tube according to claim 45, wherein said two cylindrical holder members having large and small diameters, respectively, are separately formed and are held detachably from each other;

static beam convergence correction magnets are rotatably mounted around the outer surface of said cylindrical holder member having the large diameter; and said coil member is fixed around the outer surface of said cylindrical holder member having the small diameter.

47. A color cathode ray tube according to claim 45, wherein a plurality of magnet rings for generating at least one set of magnetic fields having an even number of poles are fitted on said cylindrical holder member having the large diameter.

48. A color cathode ray tube according to claim 45, wherein said coil member is divided into two or more of flexible films each containing a plurality of printed coils and disposed in a stacked state.

49. A color cathode ray tube according to claim 45, wherein said coil member is formed of a flexible film containing a plurality of printed coils for generating at least one kind of two-pole magnetic fields, four-pole magnetic fields, and six-pole magnetic fields.

50. A color cathode ray tube according to claim 47, wherein said coil member is divided into two or more of flexible films each containing a plurality of printed coils and disposed in a stacked state.

51. A color cathode ray tube according to claim 47, wherein said coil member is formed of a flexible film containing a plurality of printed coils for generating at least one kind of two-pole magnetic fields, four-pole magnetic fields, and six-pole magnetic fields.

52. A color display system employing color cathode ray tube according to claim 45.

53. A color display system comprising a color cathode ray tube and a dynamic beam convergence power supply means, said color cathode ray tube comprising:

an evacuated envelope including a panel portion, a neck portion, and a funnel portion connecting said panel portion to said neck portion;

a phosphor screen formed on an inner surface of said panel portion;

a color selection electrode disposed spaced from said phosphor screen in said panel portion;

an in-line electron gun contained in said neck portion, for generating one center electron beam and two side electron beams and directing said three electron beams toward said phosphor screen;

a deflection device mounted in the vicinity of a junction between said neck portion and said funnel portion, for deflecting said three electron beams in horizontal and vertical directions and self-converging said three electron beams;

a first magnetic field generating means comprising permanent magnets, mounted on said neck portion, for generating an adjustable magnetic field to move said two side electron beams in opposite directions;

a second magnetic field generating means comprising permanent magnets, mounted on said neck portion, for generating an adjustable magnetic field to move said two side electron beams in a same direction;

a third magnetic field generating means comprising permanent magnets, mounted on said neck portion, for generating an adjustable magnetic field to move said three electron beams in a same direction;

a first electromagnetic coil means comprising coreless electromagnetic coils, mounted on said neck portion, for generating an adjustable magnetic field to move said two side electron beams in opposite directions;

a second electromagnetic coil means comprising coreless electromagnetic coils, mounted on said neck portion, for generating an adjustable magnetic field to move said two side electron beams in a same direction; and a third electromagnetic coil means comprising coreless electromagnetic coils, mounted on said neck portion, for generating an adjustable magnetic field to move said three electron beams in a same direction;

wherein said dynamic beam convergence power supply means supplies correction currents in synchronization with deflection of said three electron beams to said first electromagnetic coil means and said second electromagnetic coil means.

54. A color cathode ray tube comprising:

an evacuated envelope including a panel portion, a neck portion, and a funnel portion connecting said panel portion to said neck portion;

a phosphor screen formed on an inner surface of said panel portion;

a color selection electrode disposed spaced from said phosphor screen in said panel portion;

an in-line electron gun contained in said neck portion, for generating one center electron beam and two side electron beams and directing said three electron beams toward said phosphor screen;

a deflection device mounted in the vicinity of a junction between said neck portion and said funnel portion, for deflecting said three electron beams in horizontal and vertical directions and self-converging said three electron beams;

a first magnetic field generating means comprising permanent magnets, mounted on said neck portion, for generating an adjustable magnetic field to move said two side electron beams in opposite directions;

a second magnetic field generating means comprising permanent magnets, mounted on said neck portion, for generating an adjustable magnetic field to move said two side electron beams in a same direction;

a third magnetic field generating means comprising permanent magnets, mounted on said neck portion, for generating an adjustable magnetic field to move said three electron beams in a same direction;

a first electromagnetic coil means comprising coreless electromagnetic coils, mounted on said neck portion, for generating an adjustable magnetic field to move said two side electron beams in opposite directions;

a second electromagnetic coil means comprising coreless electromagnetic coils, mounted on said neck portion, for generating an adjustable magnetic field to move said two side electron beams in a same direction; and a third electromagnetic coil means comprising coreless electromagnetic coils, mounted on said neck portion, for generating an adjustable magnetic field to move said three electron beams in a same direction.

55. A color cathode ray tube having a beam deflection yoke and provided with a convergence correction device in a neck portion of the color cathode ray tube, the convergence correction device comprising:

a cylindrical holder member formed separately from the deflection yoke;

a coil member including a plurality of printed coils formed of spiral coil conductors for generating magnetic fields having an even number of poles and contained between nonmagnetic insulating films, the coil member being disposed on an inner surface of the cylindrical holder member; and a plurality of magnetic rings for generating magnetic fields having an even number of poles, the plurality of magnet rings being rotatably mounted around an outer surface of the cylindrical holder member.

56. A color cathode ray tube according to claim 55, wherein the cylindrical holder member is provided with a mechanism to engage with the deflection yoke for positioning the convergence correction device in a rotational direction around an axis of the color cathode ray tube.

57. A color display system employing a color cathode ray tube according to claim 55.

* * * * *